US007980188B2

(12) United States Patent
Shimizu

(10) Patent No.: US 7,980,188 B2
(45) Date of Patent: Jul. 19, 2011

(54) CLOTH-HOLDER FRAME TRANSFER APPARATUS FOR SEWING MACHINE

(75) Inventor: Masaki Shimizu, Toyoake (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 1115 days.

(21) Appl. No.: 11/717,129

(22) Filed: Mar. 13, 2007

(65) Prior Publication Data

US 2007/0227425 A1 Oct. 4, 2007

(30) Foreign Application Priority Data

Mar. 14, 2006 (JP) ..... 2006-068876

(51) Int. Cl.
*D05B 39/00* (2006.01)

(52) U.S. Cl. ..... 112/470.18; 112/470.14; 700/136

(58) Field of Classification Search ..... 112/102.5, 112/103, 470.01, 470.06, 470.09, 470.14, 112/470.18; 700/136–138
See application file for complete search history.

(56) References Cited

U.S. PATENT DOCUMENTS

| | | | | |
|---|---|---|---|---|
| 4,248,170 | A * | 2/1981 | Adamski et al. | 112/470.03 |
| 6,167,824 | B1 * | 1/2001 | Tomita | 112/102.5 |
| 6,470,813 | B2 * | 10/2002 | Ebata et al. | 112/102.5 |
| 6,718,893 | B1 * | 4/2004 | Kong | 112/102.5 |
| 6,820,565 | B1 | 11/2004 | Kawaguchi et al. | |
| 6,871,606 | B2 * | 3/2005 | Schweizer | 112/102.5 |
| 6,883,446 | B2 * | 4/2005 | Koerner | 112/475.02 |
| 6,994,042 | B2 * | 2/2006 | Schweizer | 112/470.03 |
| 7,373,891 | B2 * | 5/2008 | Koerner | 112/103 |
| 2001/0050036 | A1 * | 12/2001 | Ebata et al. | 112/102.5 |
| 2002/0083873 | A1 * | 7/2002 | Sano et al. | 112/102.5 |
| 2003/0084831 | A1 * | 5/2003 | Durville | 112/102.5 |
| 2003/0131773 | A1 * | 7/2003 | Schweizer | 112/102.5 |
| 2005/0115482 | A1 * | 6/2005 | Schweizer | 112/470.01 |
| 2006/0027154 | A1 | 2/2006 | Naka et al. | |

FOREIGN PATENT DOCUMENTS

| | | |
|---|---|---|
| JP | A 5-005262 | 1/1993 |
| JP | A 5-192466 | 8/1993 |
| JP | A 5-192467 | 8/1993 |
| JP | A 6-343778 | 12/1994 |
| JP | A 8-112465 | 5/1996 |
| JP | B2 3547496 | 4/2004 |
| JP | A 2004-254987 | 9/2004 |
| JP | A 2005-102792 | 4/2005 |
| JP | A 2006-043232 | 2/2006 |

* cited by examiner

*Primary Examiner* — Gary L. Welch
*Assistant Examiner* — Nathan E Durham
(74) *Attorney, Agent, or Firm* — Oliff & Berridge, PLC

(57) ABSTRACT

A cloth-holder frame transfer apparatus for a sewing machine includes a carriage detachably attachable to a cloth-holder frame holding workpiece cloth, a carriage driving mechanism including an actuator moving the carriage in two directions intersecting each other on a horizontal plane, an external force detector which detects an external force applied by an operator to the cloth-holder frame attached to the carriage, an assisting force output device which produces force assisting the movement of the cloth-holder frame by the external force, and a control device controlling the assisting force output device based on the external force detected by the external force detector. The carriage driving mechanism includes first and second direction movement actuators provided with first and second direction displacement sensors respectively. The first and second direction movement actuators include respective stepping motors, and the first and second direction displacement sensors include respective rotary encoders.

13 Claims, 18 Drawing Sheets

FIG. 14

PATTERN DATA

| DATA NUMBER N | 74 |
|---|---|
| No. | DATA |
| 1 | 0.5 |
| 2 | -0.5 |
| 3 | 0.5 |
| 4 | -0.5 |
| : | : |
| 15 | 0.5 |
| 16 | -0.9 |
| 17 | 1.3 |
| 18 | -1.7 |
| 19 | 2.1 |
| 20 | -2.5 |
| : | : |
| 29 | 4.0 |
| 30 | -4.0 |
| 31 | 3.9 |
| 32 | -3.8 |
| 33 | 3.7 |
| : | : |
| 72 | -0.5 |
| 73 | 0.5 |
| 74 | -0.5 |

CLOTH-HOLDER FRAME TRANSFER APPARATUS FOR SEWING MACHINE

CROSS-REFERENCE TO RELATED APPLICATIONS

This application is based upon and claims the benefit of priority from the prior Japanese Patent Application No. 2006-68876 filed on Mar. 14, 2006, the entire contents of which are incorporated herein by reference.

BACKGROUND

1. Technical Field

The present disclosure relates to a cloth-holder frame transfer apparatus for a sewing machine, which assists transfer of a cloth-holder frame by an external force when the external force has been applied to the cloth-holder frame by an operator.

2. Description of the Related Art

Embroidery sewing machines have conventionally been provided with a needlebar lifting mechanism which lifts up and down a needlebar having a lower end to which a sewing needle is attached, a thread seizing mechanism having a rotary hook, a cloth-holder frame which holds workpiece cloth so that stitches are formed on the workpiece cloth and a cloth-holder frame transfer apparatus which transfers the cloth-holder frame while holding the cloth-holder frame in a horizontal state. An embroidery pattern is sewn onto the workpiece cloth held by the cloth-holder frame in cooperation among the needlebar lifting mechanism, the thread seizing mechanism, the cloth-holder frame transfer apparatus and the like. See JP-A-2004-254987, for example.

The cloth-holder frame transfer apparatus comprises a carriage to which a cloth-holder frame is detachably attachable and a carriage driving mechanism having a feed motor which moves the carriage in two directions perpendicular to each other on a horizontal plane. A stepping motor or DC servomotor is applied to the feed motor. Furthermore, some of the conventional cloth-holder frame transfer apparatuses are provided with a rotary encoder detecting an amount of displacement of the feed motor so that results of detection are utilized for control of the feed motor.

When the operator designates a desired embroidery pattern and turns on a start switch with a cloth-holder frame being attached to the carriage, a control device of the embroidery sewing machine controls the needlebar lifting mechanism and the thread seizing mechanism (sewing machine motor). Furthermore, the control device controls the carriage driving mechanism (feed motor) so that the cloth-holder frame is automatically transferred by the cloth-holder frame transfer apparatus, whereby the designated embroidery pattern is automatically sewn on the workpiece cloth.

In the above-described case, a control device of the cloth-holder frame transfer apparatus reads embroidery data defining a plurality of needle locations regarding the designated embroidery pattern and controls the carriage driving mechanism so that the workpiece cloth is moved to a location where the needle is capable of dropping to a subsequent needle location when the sewing needle is assuming a needle-up position where the sewing needle is located higher than the workpiece cloth.

On the other hand, JP-A-2006-43232 discloses a sewing machine which is switchable between an embroidery sewing mode and a normal sewing mode. The sewing machine disclosed in the publication has been put to practice. In the embroidery sewing mode, an embroidery machine including a carriage and a carriage driving mechanism is detachably attached to a sewing machine bed. The cloth-holder frame is supported horizontally and automatically transferred as described above, whereby an embroidery pattern is sewn on the workpiece cloth. In the normal sewing mode, the embroidery machine is detached from the bed, and the workpiece cloth is transferred along a needle plate so that a normal pattern such as a satin pattern or the like is sewn on the workpiece cloth.

In the above-described type sewing machine, the workpiece cloth is fed in a predetermined direction by a feed dog while being pressed against a needle plate by a presser foot, in the same manner as in general sewing machines. In this case, the operator changes the direction of the workpiece cloth with his or her hand being put on the workpiece cloth, whereby the direction of stitches of an ordinary pattern can be changed relative to the workpiece cloth. An amount of feed of the workpiece cloth by the feed dog (stitch pitch) can be set before or during sewing. A sewing speed is adjustable by operation of a sewing speed knob, a foot controller or the like.

The sewing machine dedicated to embroidering as disclosed by the above-mentioned JP-A-2004-254987 is arranged so as to carry out sewing based on embroidery data of embroidery pattern. Accordingly, this sewing machine cannot carry out a sewing manner in which the workpiece cloth is sewn while the operator transfers the workpiece cloth along the needle plate thereby to change the stitch direction freely at a suitable stitch pitch.

When the embroidery machine is detached in the sewing machine of the above-mentioned JP-A-2006-43232 and the sewing machine is switched to the normal sewing mode, a normal pattern can be sewn while the stitch direction is changed at a suitable stitch pitch. However, the embroidery machine needs to be attached to and detached from the sewing machine in order that the sewing machine may be switched between the normal sewing mode and the embroidery sewing mode. As a result, a detaching or attaching work is troublesome, resulting in inconvenience. In view of these circumstances, it has been considered that sewing would be carried out by a sewing machine capable of sowing an embroidery pattern, such as disclosed in the above-mentioned documents, so that the carriage driving mechanism would be rendered non-operative and the operator would manually apply an external force to the cloth-holder frame attached to the carriage to move the cloth-holder frame freely.

However, the carriage and the feed motor of the carriage driving mechanism are connected to each other so as to be operated together. Accordingly, the carriage needs to be moved against detent torque acting on the feed motor or load applied to the carriage driving mechanism even when electric supply to the feed motor is interrupted such that the carriage driving mechanism is non-operative. As a result, moving the cloth-holder frame attached to the carriage necessitates a large external force, and it is difficult to move the cloth-holder frame smoothly in a desired direction. More specifically, it is difficult to sew the workpiece cloth held by the cloth-holder frame at a suitable stitch pitch with the stitch direction being changed freely and this has little practicability.

In general sewing machines, workpiece cloth is fed by a feed dog while being pressed against a needle plate by a presser foot. Accordingly, there is a problem that it is difficult for beginners to change the stitch direction desirably by smoothly changing the direction of the workpiece cloth during sewing of an ordinary pattern. Furthermore, an amount of feed of the workpiece cloth by the teed dog (stitch pitch) needs to be set before or during sewing, and a sewing speed needs to be adjusted by the operation of a sewing speed knob, fool controller or the like. This results in an increase in an amount of operation and accordingly inconvenience.

SUMMARY

Therefore, an object of the disclosure is to provide a cloth-holder frame transfer apparatus for a sewing machine, which produces a force assisting the movement of the cloth-holder frame by an external force when the external force has been applied to the cloth-holder frame by an operator.

The present disclosure provides a cloth-holder frame transfer apparatus for a sewing machine which is usable with a cloth-holder frame, the apparatus comprising a carriage detachably attachable to the cloth-holder frame holding workpiece cloth, a carriage driving mechanism including an actuator moving the carriage in two directions intersecting each other on a horizontal plane, an external force detector which detects an external force applied to the cloth-holder frame attached to the carriage, an assisting force output device which produces force assisting the movement of the cloth-holder frame by the external force, and a control device which controls the assisting force output device based on the external force detected by the external force detector, wherein the carriage driving mechanism includes first and second direction movement actuators which are provided with first and second direction displacement sensors respectively, and the first and second direction movement actuators comprise respective stepping motors, and the first and second direction displacement sensors comprise respective rotary encoders.

A sewing machine provided with the above-described cloth-holder frame transfer apparatus can sew embroidery patterns on workpiece cloth. In other words, the cloth-holder frame transfer apparatus can be applied to sewing machines which are embroidery-sewable. In the cloth-holder frame transfer apparatus, the external force detector detects an external force the operator applies to the cloth-holder frame attached to the carriage. For example, the external force detector is provided on or near to any one of the carriage driving mechanism, carriage and cloth-holder frame. A magnitude and direction of the external force are detected by the external force detector and used for control of the assisting force output device by the control device.

The control device controls the assisting force output device based on the external force detected by the external force detector. The assisting force output device produces a force assisting movement of the cloth-holder frame by the external force. More specifically, when the operator applies an external force to the cloth-holder frame attached to the carriage in order to move the cloth-holder frame manually, a suitable force assisting the movement of the cloth-holder frame is produced according to the magnitude and direction of the detected external force. Consequently, the cloth-holder frame can be transferred freely, smoothly and appropriately from the operator's free will.

Accordingly, the operator can sew a desired normal pattern on the workpiece cloth held on the cloth-holder frame easily but reliably using the sewing machine provided with the above-described cloth-holder frame transfer apparatus, whereupon a free motion quilting can be carried out. Moreover, embroidery patterns can also be sewn on the workpiece cloth by the sewing machine provided with the cloth-holder frame transfer apparatus. Accordingly, when the cloth-holder frame transfer apparatus is applied to a sewing machine which is embroidery sewable, both embroidery patterns and normal patterns can easily be sewn without inconvenient work.

BRIEF DESCRIPTION OF THE DRAWINGS

Other objects, features and advantages of the present disclosure will become clear upon reviewing the following description of the illustrative examples with reference to the accompanying drawings, in which:

FIG. 14 shows pattern data;

DETAILED DESCRIPTION OF THE DISCLOSURE

Figure 1:
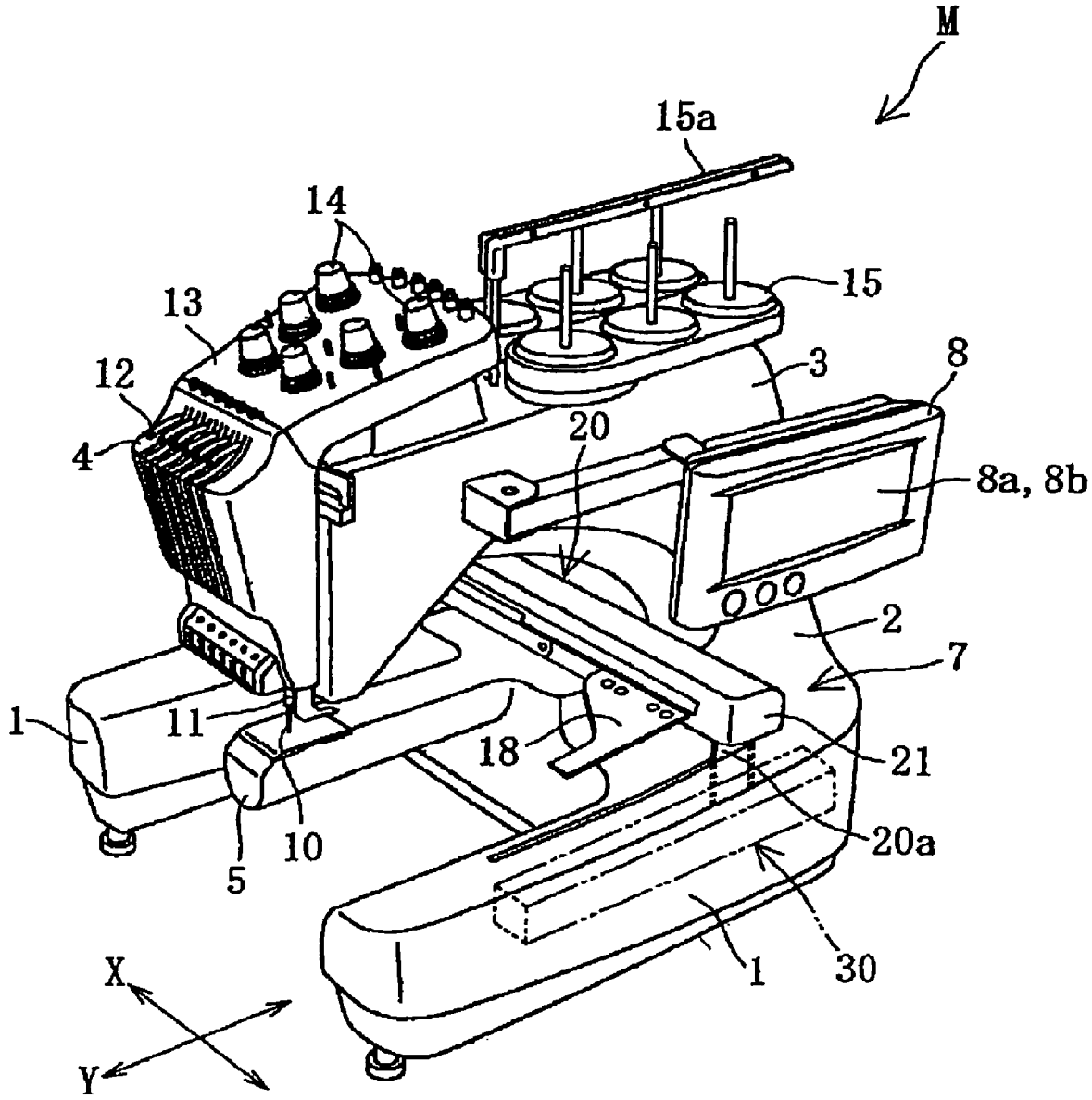
FIG. 1 is a perspective view of a multineedle sewing machine in accordance with one illustrative example of the disclosure.
Figure 2:
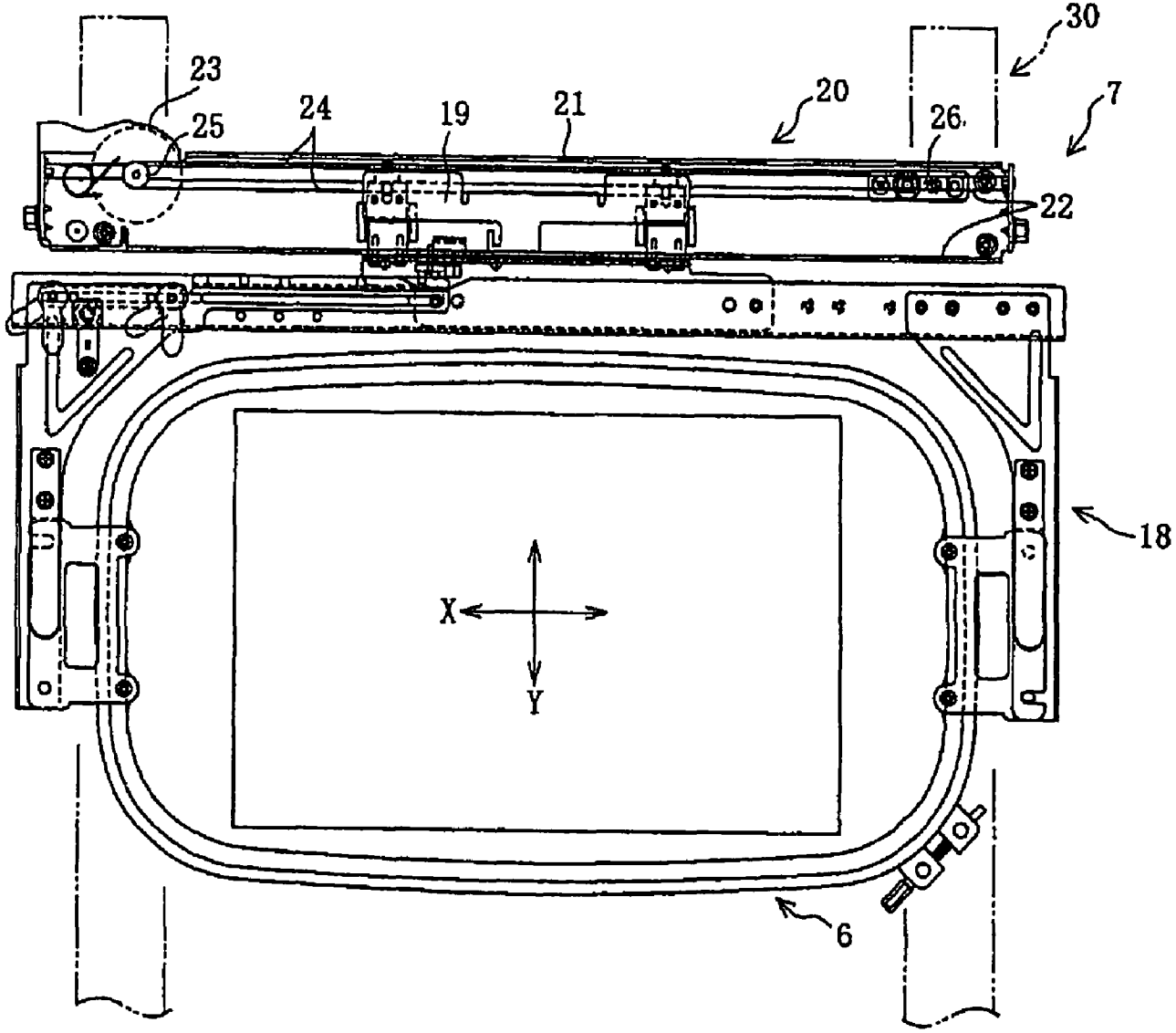
FIG. 2 is a plan view of a cloth-holder frame and a carriage driving mechanism.
Figure 3:
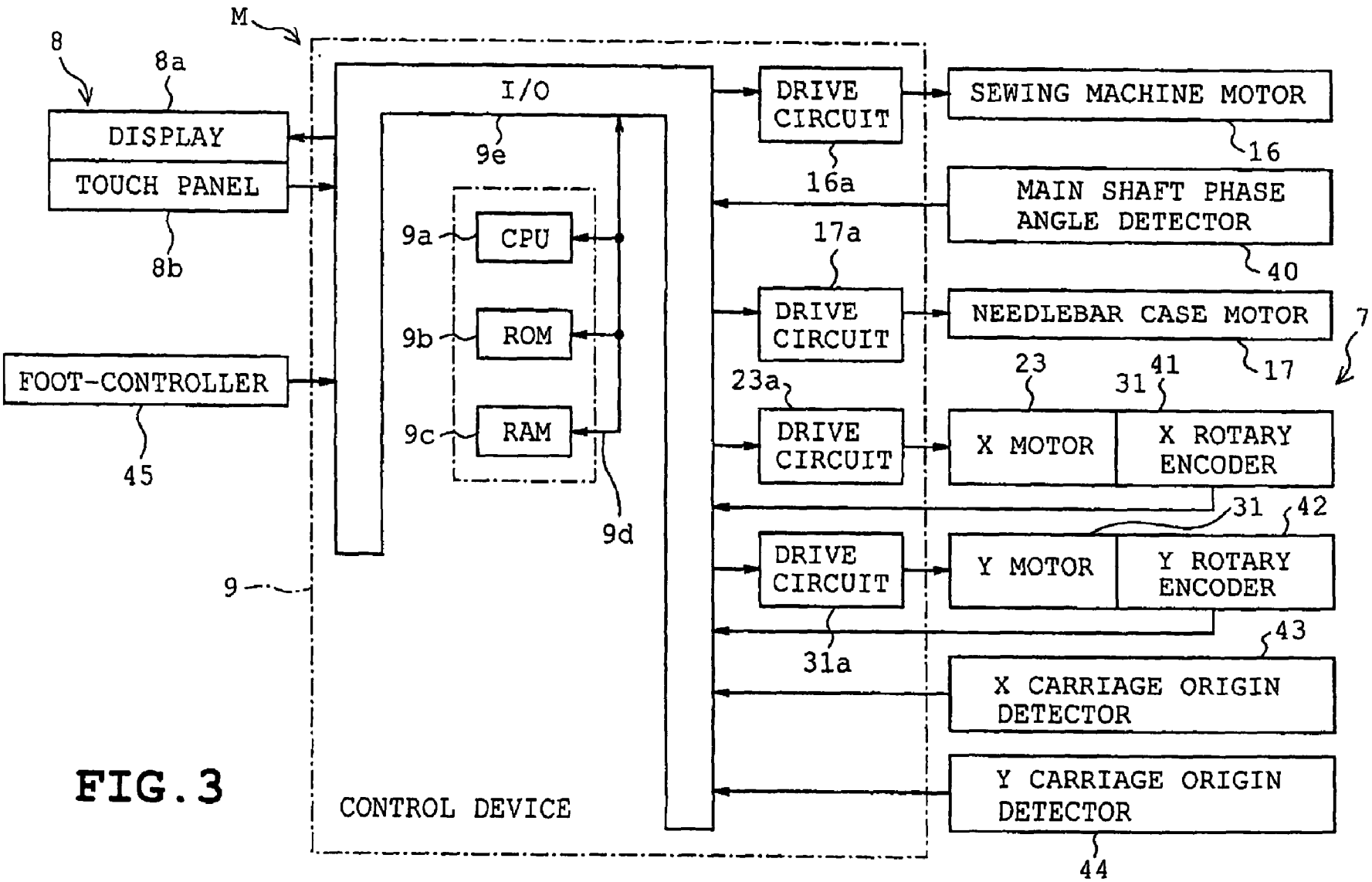
FIG. 3 is a block diagram showing an electrical arrangement of the control system of the multineedle sewing machine.

A first illustrative example of the present disclosure will be described with reference to FIGS. 1 to 6. Referring to FIGS. 1 to 3, a multineedle sewing machine M includes a bifurcated support leg 1, a sewing pillar 2 standing on a rear end of the support leg 1, a sewing arm 3 extending frontward from an upper end of the pillar 2 and a needlebar case 4 which is attached to a distal end of the arm 3 so as to be movable in the right-left direction. The sewing machine M further includes a cylinder bed 5 extending frontward from a lower end of the pillar 2, a cloth-holder frame 6 to which workpiece cloth is detachably attached thereby to hold the workpiece cloth, a cloth-holder frame transfer apparatus 7 transferring the cloth-holder frame 6 horizontally supported on an upper side of the cylinder bed 5, an operation panel 8 further including a display 8*a* operated by an operator so that various pieces of information is entered and a touch panel 8*b*, and a control device 9 controlling the overall multineedle sewing machine M.

To the needlebar case 4 arc attached six needlebars 11 having lower ends on which sewing needles 10 are mounted and six thread take-ups 12 corresponding to the needlebars 11, respectively. The needlebars 11 and the thread take-ups 12 are placed side by side in the right-left direction. A reverse sewing lever plate 13 is provided on an upper end of the needlebar case 4 so as to protrude to the front half side of the arm 3. Six thread tensioners 14 are attached to the reverse sewing lever plate 13. Six thread spool stands 15 are disposed on the rear half of the arm 3. A thread guide bar 15*a* is provided over the thread spool stands 15. Six thread spools are settable on the thread spool stands 15 respectively. Needle threads extending from the set thread spools are supplied through the thread guide bar 15*a* and the thread tensioners 14, the thread take-ups 12 and the like to the sewing needles 10.

A sewing machine motor 16 (see FIG. 3) is provided in the pillar 2. The arm 3 includes a needlebar lifting mechanism and a thread take-up swinging mechanism and a needlebar/thread take-up switching mechanism each of which is driven via a main shaft by the sewing machine motor 16. The needlebar/thread take-up switching mechanism is provided with a needlebar case motor 17 (see FIG. 3) which moves the needlebar case 4 in the right-left direction so that one of the six needlebars 11 and one of the thread take-ups corresponding to the needlebar 11 are selectively switched into respective operative positions. Only the single needlebar 11 switched into the operative position by the needlebar/thread take-up switching mechanism is lifted up by the needlebar lifting mechanism. Furthermore, only the single thread take-up 12 switched into the operative position is swung up and down by the thread take-up swinging mechanism. A thread seizing mechanism is provided in the cylinder bed 5 and has a rotary hook driven by the sewing machine motor 16. Stitches are formed on the workpiece cloth placed on the cylinder bed 5 by the cooperation of the thread seizing mechanism, the sewing needle 10 lifted up and down and the like.

The cloth-holder frame transfer apparatus 7 will now be described in detail. Referring to FIGS. 1 to 3, the cloth-holder frame transfer apparatus 7 includes a carriage 19 detachably attached via a frame holder 18 to the cloth-holder frame 6, an X carriage driving mechanism 20 moving the carriage 19 in the X direction and a Y carriage driving mechanism 30 moving the carriage 19 in the Y direction. The X carriage driving mechanism 20 is provided on the upper side of the support leg 1 and enclosed in a movable case 21 which is elongated in the right-left direction and has an open lower end. The X carriage driving mechanism 20 is constructed so as to directly support and move the carriage 19 in the X direction. The X carriage driving mechanism 20 includes a guide 22 supporting the carriage 19 so that the carriage 19 is movable in the X direction, an X motor 23 comprised of a stepping motor and a loop timing belt 24 transferring a drive force of the X motor 23 to the carriage 19. The timing belt 24 extends between two pulleys 25 and 26 and is joined with the carriage 19. The pulley 25 is rotated by the X motor 23.

The Y carriage driving mechanism 30 is enclosed in the support leg 1 and constructed so as to support the X carriage driving mechanism 20 and the movable case 21 together with the carriage 19 so that the X carriage driving mechanism 20 and the movable case 21 are moved in the Y direction. The Y carriage driving mechanism 30 includes a pair of guides supporting a pair of legs 20*a* each extending downward from a frame of the X carriage driving mechanism 20 respectively and a Y motor 31 comprised of a stepping motor and a pair of loop timing belts transmitting a drive force of the Y motor 31 to the legs 20*a*. The paired timing belts extend between two pulleys and are joined with the legs 20*a* respectively. One of the pulleys is rotated by the Y motor 31.

A main shaft phase angle detector 40 is provided on a main shaft or the sewing machine motor 16 to detect a phase angle of the main shaft rotated by the sewing machine motor 16. The main shaft phase angle detector 40 includes, for example, a first encoder capable of detecting a reference position of the main shaft and a second encoder capable of detecting a displacement angle of the main shaft for every predetermined angle (0.5 degrees, for example). Furthermore, an X rotary encoder 41 is provided on the X motor 23 and is capable of detecting an amount of displacement (displacement angle) of the X motor 23 for every predetermined angle (0.5 degrees, for example). A Y rotary encoder 42 is provided on the Y motor 31 and is capable of detecting an amount of displacement (displacement angle) of the Y motor 31 for every predetermined angle (0.5 degrees, for example). The rotary encoders 41 and 42 are fixed to drive shafts of the X and Y motors 23 and 31 respectively. Each rotary encoder includes a disc having a plurality of slits radially formed therethrough at slight circumferential intervals and an optical detector having a light emitting part and a light receiving part both of which are disposed at opposite sides of the disc respectively.

An X carriage origin detector 43 is provided in the movable case 21 to detect an origin of the carriage 19 in the X direction. A Y carriage origin detector 44 is provided in the support leg 1 to detect an origin of the carriage in the Y direction based on a position of the leg 20*a*. For example, the X and Y carriage origin detectors 43 and 44 comprise proximity switches detecting detected parts mounted on the carriage 19 and the leg 20*a* respectively.

The following describes the control system of the multineedle sewing machine M including the cloth-holder frame transfer apparatus 7. Referring to FIG. 3, the cloth-holder frame transfer apparatus 7 includes the operation panel 8, the control device 9, the X motor 23, the Y motor 31, the main shaft phase angle detector 40, the X rotary encoder 41, the Y rotary encoder 42, the X carriage origin detector 43, the Y carriage origin detector 44 and the foot controller 45.

The control device 9 includes a Computer further including a central processing unit (CPU) 9*a*, a read only memory (ROM) 9*b*, a random access memory (RAM) 9*c* and a bus 9*d* and an input/output interface (I/O) 9*e*. To the I/O interface 9*e* are electrically connected the operation panel 8 (the display 8*a* and the touch panel 8*b*), the foot controller 45, drive circuits 16*a*, 17*a*, 23*a* and 31*a* driving the motors 16, 17, 23 and 31 respectively and the detectors 40 to 44. The control device 9 controls the display 8*a* and the motors 16, 17, 23 and 31 based on signals supplied thereto from the touch panel 8*b* and the detectors 40 to 44.

The ROM 9*b* stores consecutive control programs which realize an embroidery pattern sewing control for automatically transferring the cloth-holder frame 6 attached to the carriage 19 so that an embroidery pattern is sewn on the workpiece cloth held on the cloth-holder frame 6, a normal pattern sewing control for manually transferring the cloth-holder frame 6 attached to the carriage 19 by the operator so that the normal pattern is sewn on the workpiece cloth held on the cloth-holder frame 6, and the like. In particular, when the operator applies an external force to the cloth-holder frame 6 attached to the carriage 19 in order that the cloth-holder frame 6 may manually be moved in the normal pattern sewing control, amounts of displacement of the X and Y motors 23 and 31 are detected by the X and Y rotary encoders 41 and 42, whereby the external force the operator has applied to the cloth-holder frame 6 is indirectly detected. The X and Y carriage driving mechanisms 20 and 30 (the X and Y motors 23 and 31) are controlled based on the detected external force, thereby producing a force assisting the movement of the cloth-holder frame 6 (assisting force).

In the above-described case, when the magnitude of the external force is equal to or larger than a predetermined threshold under the condition where the sewing needle 10 is assuming an upper position where the sewing needle 10 is located higher than the workpiece cloth held by the cloth-holder frame 6, the control device 9 controls the X and Y carriage driving mechanisms 20 and 30 so that an assisting force is applied in the direction of the external force. As a result, an amount of movement of the cloth-holder frame 6 is changed according to the magnitude of the external force.

Figure 4:
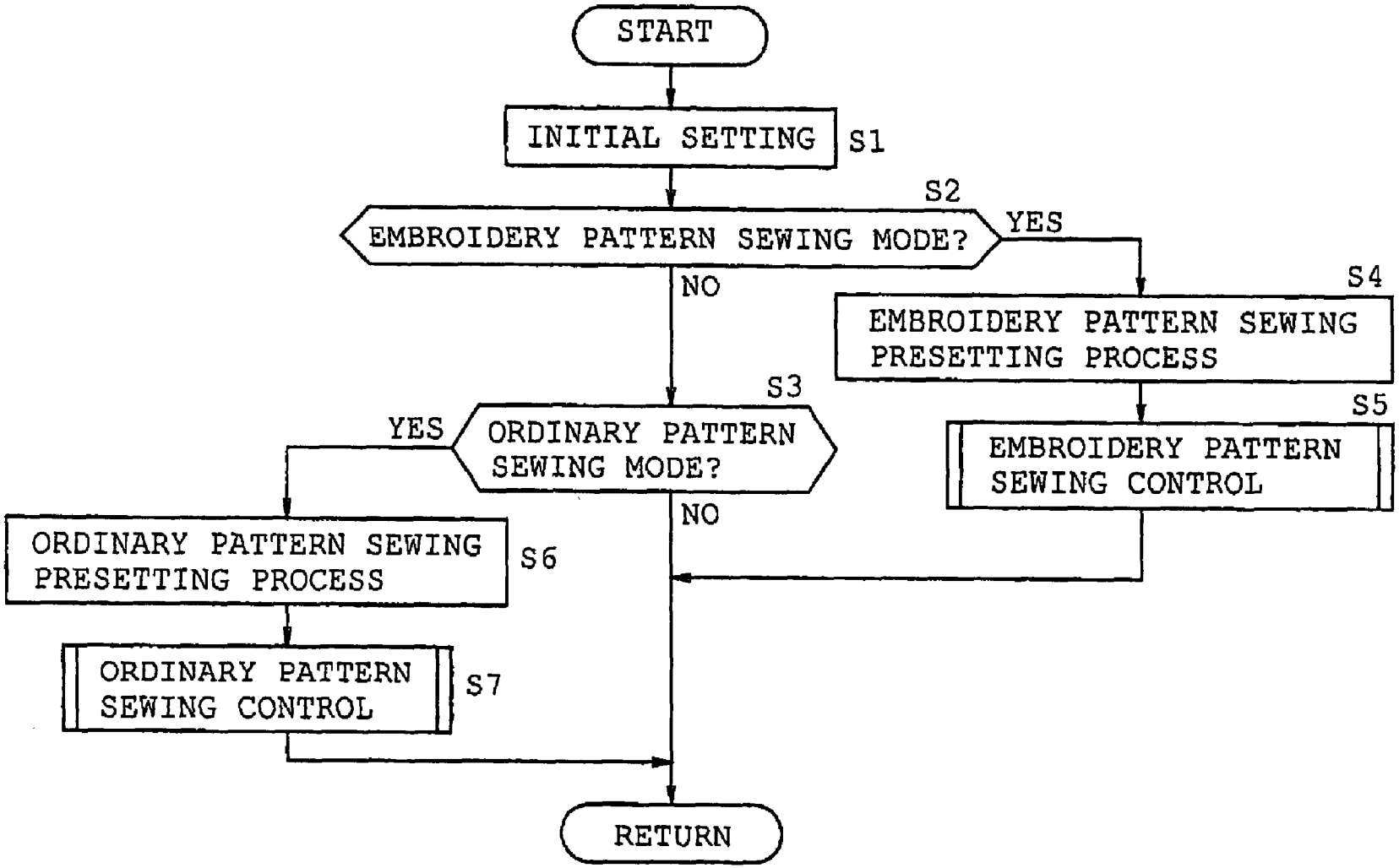
FIG. 4 is a flowchart showing a successive control executed by a control device.
Figure 5:
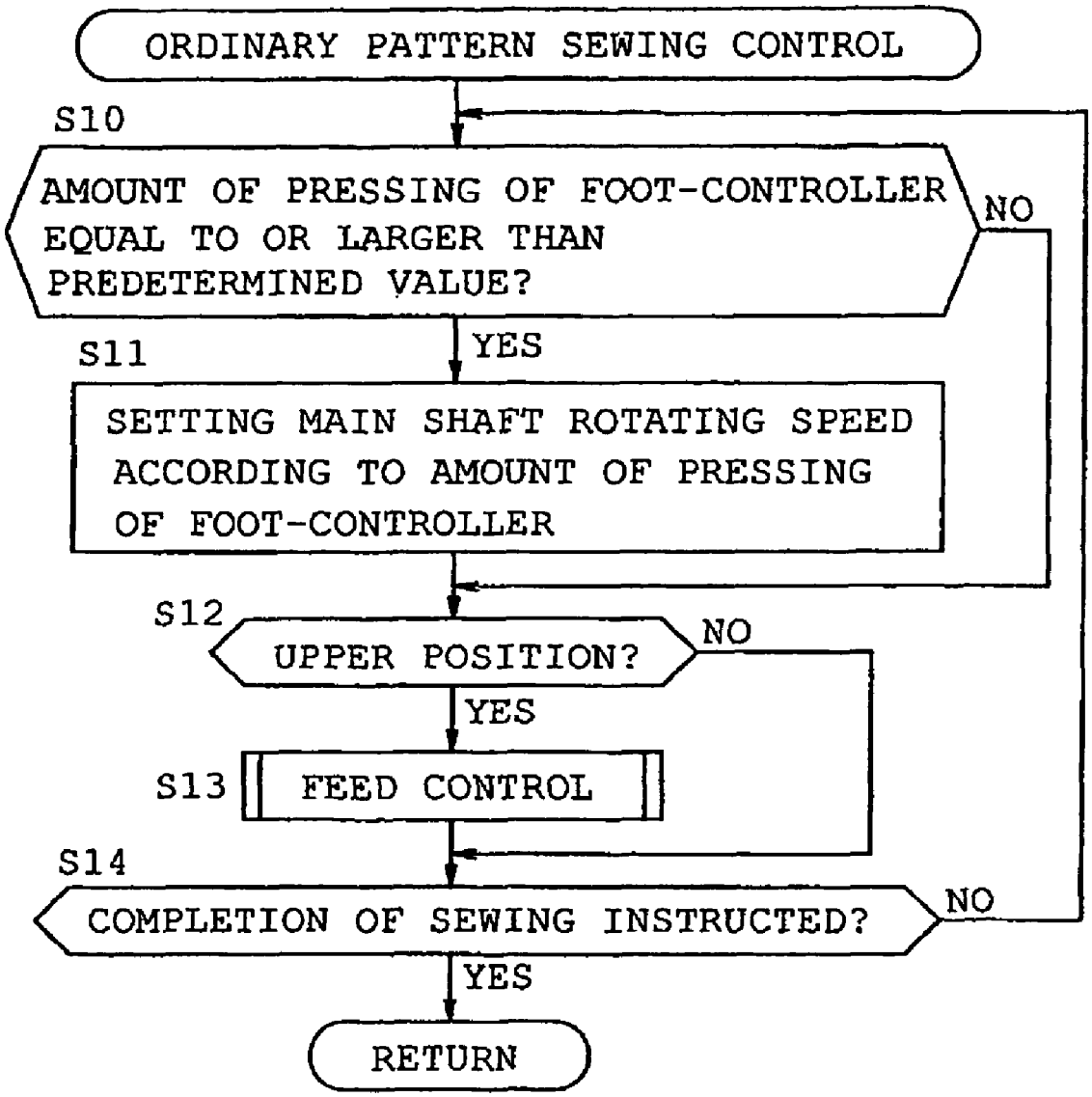
FIG. 5 is a flowchart showing a control manner of a normal pattern sewing.

A sequential control executed by the control device 9 will be described with reference to FIGS. 4 to 6. Symbol Si (where i=1, 2, 3 . . . ) designates each step in the figures. Upon start of the control, whether a sewing mode is an embroidery pattern sewing mode or an ordinary sewing mode is determined (S2 and S3) after initial setting (S1) as shown in FIG. 4. The operator can set a sewing mode using the operation panel 8. The control device 9 returns when the sewing mode is neither embroidery pattern sewing mode nor ordinary sewing mode (S2: No; and S3: No). When the sewing mode is the embroidery sewing mode (S2: Yes), the operator operates the operation panel 8 to set a desired embroidery on the control device 9 in an embroidery pattern sewing presetting process (S4). The operator can edit by changing the size, color of the embroidery or the like or set sewing conditions such as a sewing speed as the need arises. Subsequently, when the operator instructs the sewing machine to start sewing, an embroidery sewing control (S5) is carried out. The control device 9 reads data of a plurality of needle locations of the embroidery pattern set at S4 and embroidery data defining a color of each pattern. The motors 16, 17, 23 and 31 are controlled based on the read embroidery data, so that embroidery sewing is initiated. The cloth-holder frame 6 attached to the carriage 19 is automatically transferred. The needlebar is suitably switched during the sewing so that a thread color is changed. As a result, the set embroidery pattern is automatically sewn on the workpiece cloth held by the cloth-holder frame 6.

On the other hand, when the sewing mode is the normal pattern sewing mode (S2: No; and S3: Yes), the operator is allowed to operate the operation panel 8 to set a desired type of ordinary pattern and stitch pitch in an ordinary pattern sewing setting process (S6). In the first example, however, a straight pattern is set as a type of ordinary pattern, but only one stitch pitch is set in the first illustrative example. Subsequently, an ordinary pattern sewing control (S7) is carried out. Upon start of the ordinary pattern sewing control, an amount of pressing of the foot controller 45 is firstly detected as shown in FIG. 5. When the amount of pressing is equal to or larger than a predetermined value (S10: Yes), a rotational speed of the main shaft is set according to the amount of pressing (S11). The sewing machine motor 16 is controlled so that the set rotational speed of the main shaft is reached.

After the process at S11 has been executed or when determination has been made in the negative at S10, the control device 9 advances to S12 to determine whether the sewing needle 10 is located higher than the workpiece cloth held by the cloth-holder frame 6 (a needle-up position). When determining that the sewing needle is located higher than the workpiece cloth (S12: Yes), the control device 9 carries out a feed control (S13). After the process at S13 has been executed or in the case where determination is made in the negative (S12: No), the control device 9 returns when completion of sewing has been instructed (S14: Yes). The control device 9 advances to S10 again when completion of sewing has not been instructed (S14: No).

Figure 6:
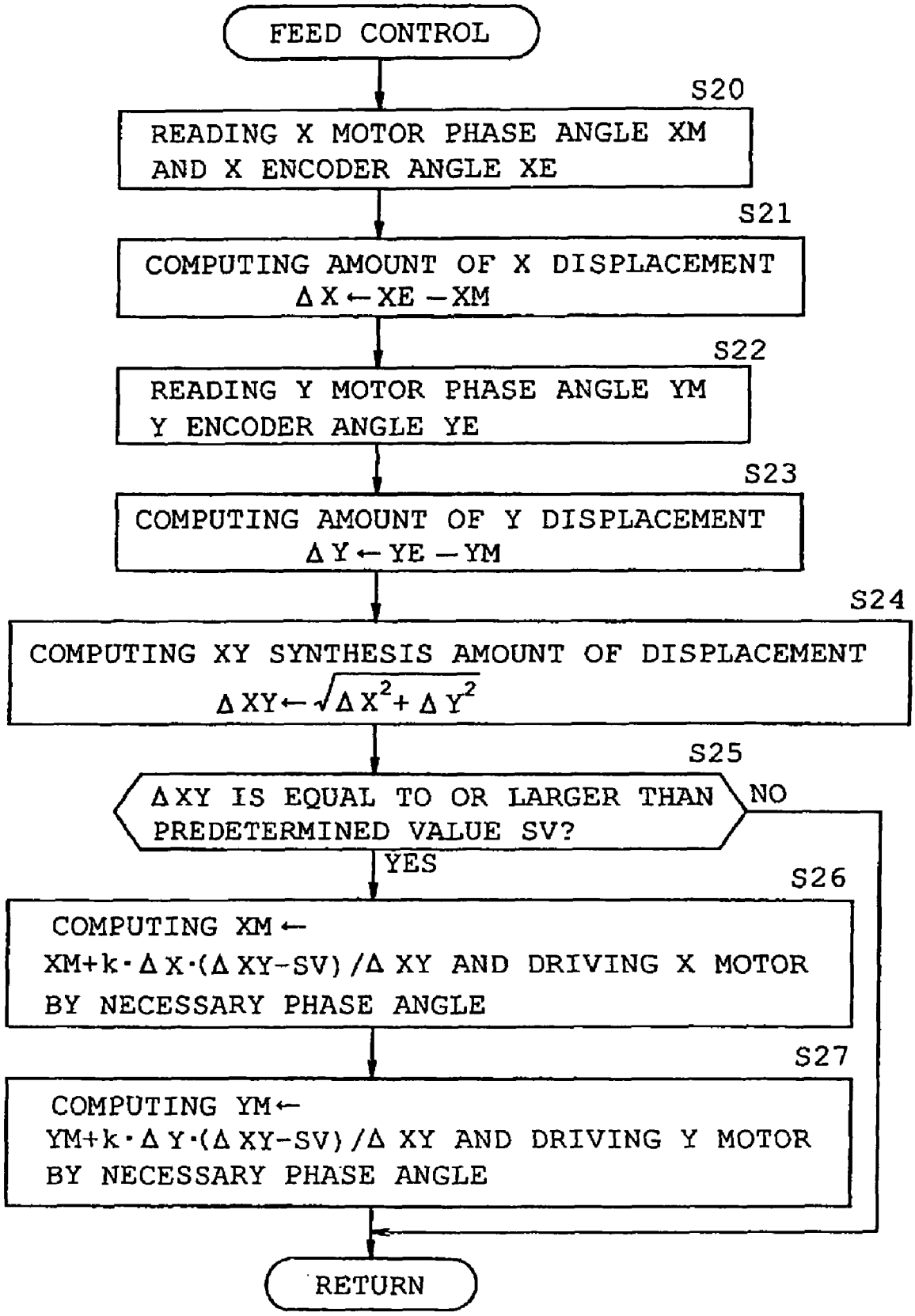
FIG. 6 is a flowchart showing a control manner of a feed control.

Upon start of the feed control at S13, data of X motor phase angle "XM" of the X motor 23 and X encoder angle "XE" are read (S20) as shown in FIG. 6. An X amount of displacement "$\Delta X \leftarrow XE - XM$" which is the difference between XM and XE is obtained by computation (S21). In the same manner, data of Y motor phase angle "YM" of the Y motor 31 and Y encoder angle "YE" are read (S22). A Y amount of displacement "$\Delta Y \leftarrow YE - YM$" which is the difference between YM and YE is obtained by computation (S23). Subsequently, an XY synthesis amount of displacement "$\Delta XY \leftarrow (\Delta X^2 + \Delta Y^2)^{1/2}$" is obtained by computation (S24). XM, XE, YM and YE are reset under the condition where the carriage 19 assumes the origins in the X and Y directions in the start of sewing. XM and YM are stored while being renewed by a buffer or the like. XE and YE are the newest encoder angles detected by the X and Y rotary encoders 41 and 42 respectively. When the operator has applied an external force to the cloth-holder frame X, the value of ΔXY becomes larger as the external force is large. Accordingly, ΔXY is a value obtained by indirectly detecting the external force.

Next, the control device 9 determines whether ΔXY is equal to or larger than a predetermined value SV (which is a predetermined threshold) (S25). When ΔXY is below SV (S25: No), the control device 9 returns. When ΔXY is equal to or larger than the predetermined value SV (S25: Yes), the control device 9 obtains an X motor phase angle, "$XM \leftarrow XM + k \cdot \Delta X \cdot (\Delta XY - SV)/\Delta XY$" by computation, whereby the X motor 23 is driven so that the obtained phase angle XM is reached (S26). In the same manner, the control device 9 obtains a Y motor phase angle, "$YM \leftarrow YM + k \cdot \Delta Y \cdot (\Delta XY - SV)/\Delta XY$" by computation, whereby tho Y motor 31 is driven so that the obtained phase angle YM is reached (S27). Symbol k is a displacement factor relative to a minimum time.

More specifically, when the sewing needle 10 assumes the needle-up position (S12: Yes), the operator applies an external force to the cloth-holder frame 6 while S20 to S25 of the feed control (S13) are repeated. In this case, when the XY synthesis amount of displacement "ΔXY" becomes equal to or larger than the predetermined value SV (S25: Yes), S20 to S27 are repeated. The X and Y motors 23 and 31 are driven so that the cloth-holder frame 6 attached to the carriage 19 is transferred in the direction of the external force, whereby straight stitches are formed on the workpiece cloth. When the XY synthesis amount of displacement "ΔXY" is increased, amounts of drive of the X and Y motors 23 and 31, that is, an amount of transfer of the cloth-holder frame 6 are also increased such that a pitch of stitches formed on the workpiece cloth is rendered larger.

In the foregoing cloth-holder frame transfer apparatus 7, the X and Y rotary encoders 41 and 42 detecting the X and Y amounts of displacement ΔX and ΔY are provided as devices for indirectly detecting the external force the operator has applied to the cloth-holder frame 6 attached to the carriage 19. The X and Y carriage driving mechanisms 20 and 30 are provided for producing force assisting the movement of the cloth-holder frame 6 by the external force. The control device 9 is provided for controlling the X and Y carriage driving mechanisms 20 and 30 based on the external force (ΔX and ΔY) detected by the X and Y rotary encoders 41 and 42.

Accordingly, when the operator applies an external force to the cloth-holder frame 6 in order to manually move the cloth-holder frame 6 attached to the carriage 19, force suitable for assisting the movement of the cloth-holder frame 6 by the external force is produced in a suitable direction. As a result, the cloth-holder frame 6 can be transferred freely, smoothly and properly based on the intention of the operator, and accordingly, a desired ordinary pattern can easily and reliably be sewn on the workpiece cloth held by the cloth-holder frame 6. Consequently, free motion quilt sewing can be realized. Moreover, since the sewing machine M provided with the cloth-holder frame transfer apparatus 7 is capable of sewing an embroidery pattern on workpiece cloth, the embroidery pattern can be sewn without requiring any inconvenient work.

When the magnitude of the external force (ΔX and ΔY) detected by the X and Y rotary encoders 41 and 42 is equal to or larger than the threshold (predetermined value SV), the control device 9 actuates the X and Y carriage driving mechanisms 20 and 30 so that the assisting force is produced in the direction of the detected external force. Accordingly, the assisting force can reliably be produced only when the operator intends to move the cloth-holder frame 6.

When the operator applies an external force to the cloth-holder frame 6, the external force is transferred via the carriage 19 to the X and Y carriage driving mechanisms 20 and 30. The X and Y rotary encoders 41 and 42 provided for detecting the amounts of displacement of the X and Y motors respectively are used. As a result, the external force can reliably be detected by an indirect manner by an amount of displacement based on the locations of the X and Y motors in the case where no external force is applied to the X and Y motors 23 and 31.

The force assisting the movement of the cloth-holder frame 6 by the external force is produced by the X and Y carriage driving mechanisms 20 and 30. Consequently, the assisting force can reliably be produced in the direction in which the operator intends to move the cloth-holder frame 6. Since no separate device is necessitated to produce the assisting force, the overall construction of the cloth-holder frame transfer apparatus can be simplified and accordingly, the costs can be reduced.

The main shaft phase angle detector 40 is provided for detecting the upper and lower positions of the needlebar 11. The control device 9 actuates the X and Y carriage driving mechanisms 20 and 30 only when the sewing needle 10 is located higher than the workpiece cloth or is assuming the needle-up position, based on the position of the needlebar detected by the main shaft phase angle detector 40. Consequently, since the cloth-holder frame 6 is prevented from being moved when the sewing needle 10 assumes the needle-down position where the sewing needle 10 is stuck into the workpiece cloth, tho sewing needle 10 can be prevented from being broken and the workpiece cloth can be prevented from being damaged.

The control device 9 controls the X and Y carriage driving mechanisms 20 and 30 so that an amount of movement of the cloth-holder frame 6 is changed according to the magnitude (an amount of X and Y synthesis displacement ΔXY) of external forces ΔX and ΔY detected by the X and Y rotary encoders 41 and 42. Accordingly, in the sewing, the operator changes the magnitude of the external force applied to the cloth-holder frame 6 so that the amount of movement of the cloth-holder frame 6, namely, a pitch of stitches formed on the workpiece cloth can be changed. As a result, the conveniences of the apparatus can be improved.

Figure 7:
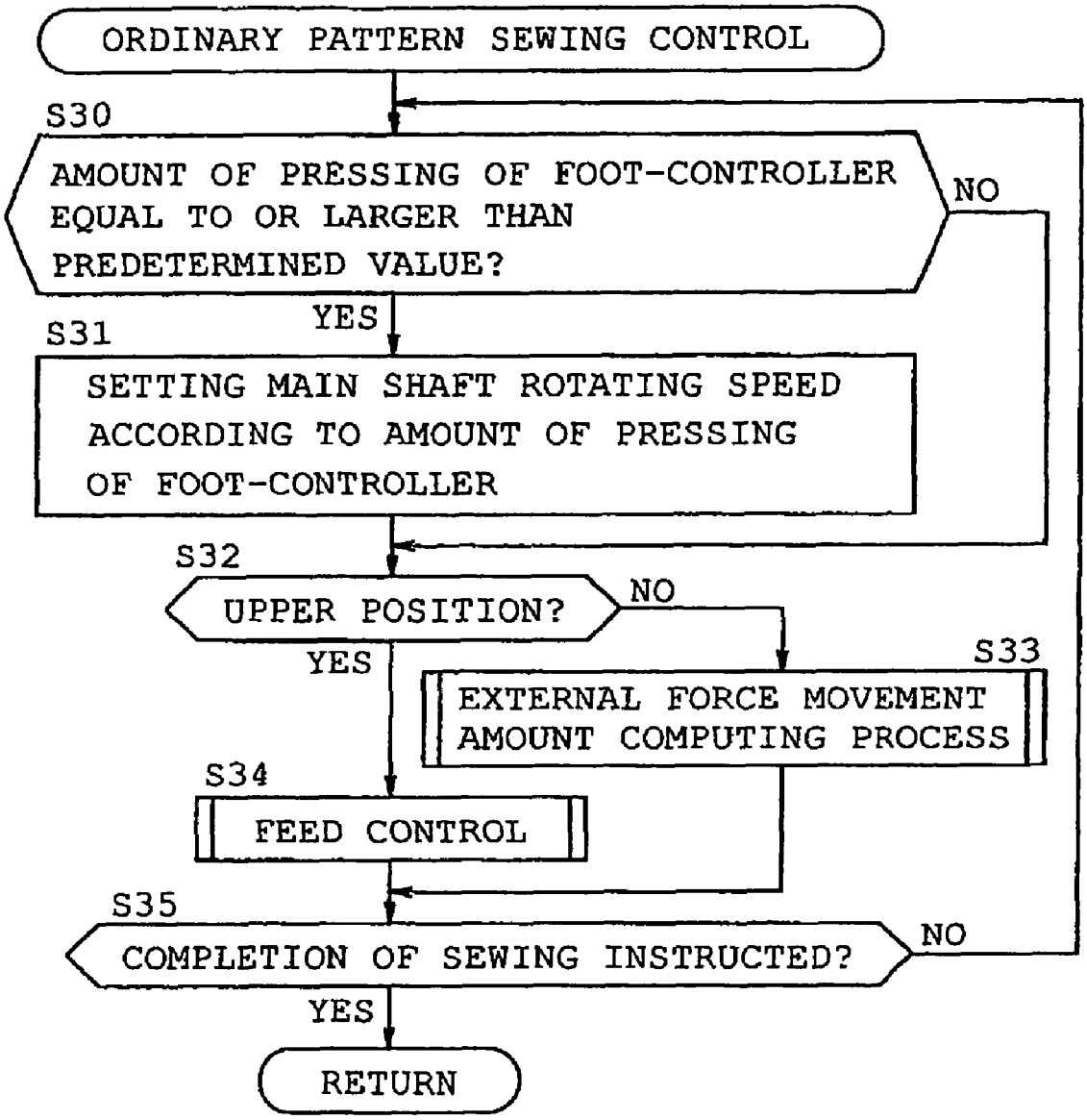
FIG. 7 is a flowchart showing a first half of control manner of the normal pattern sewing in a second embodiment of the present disclosure.
Figure 8:
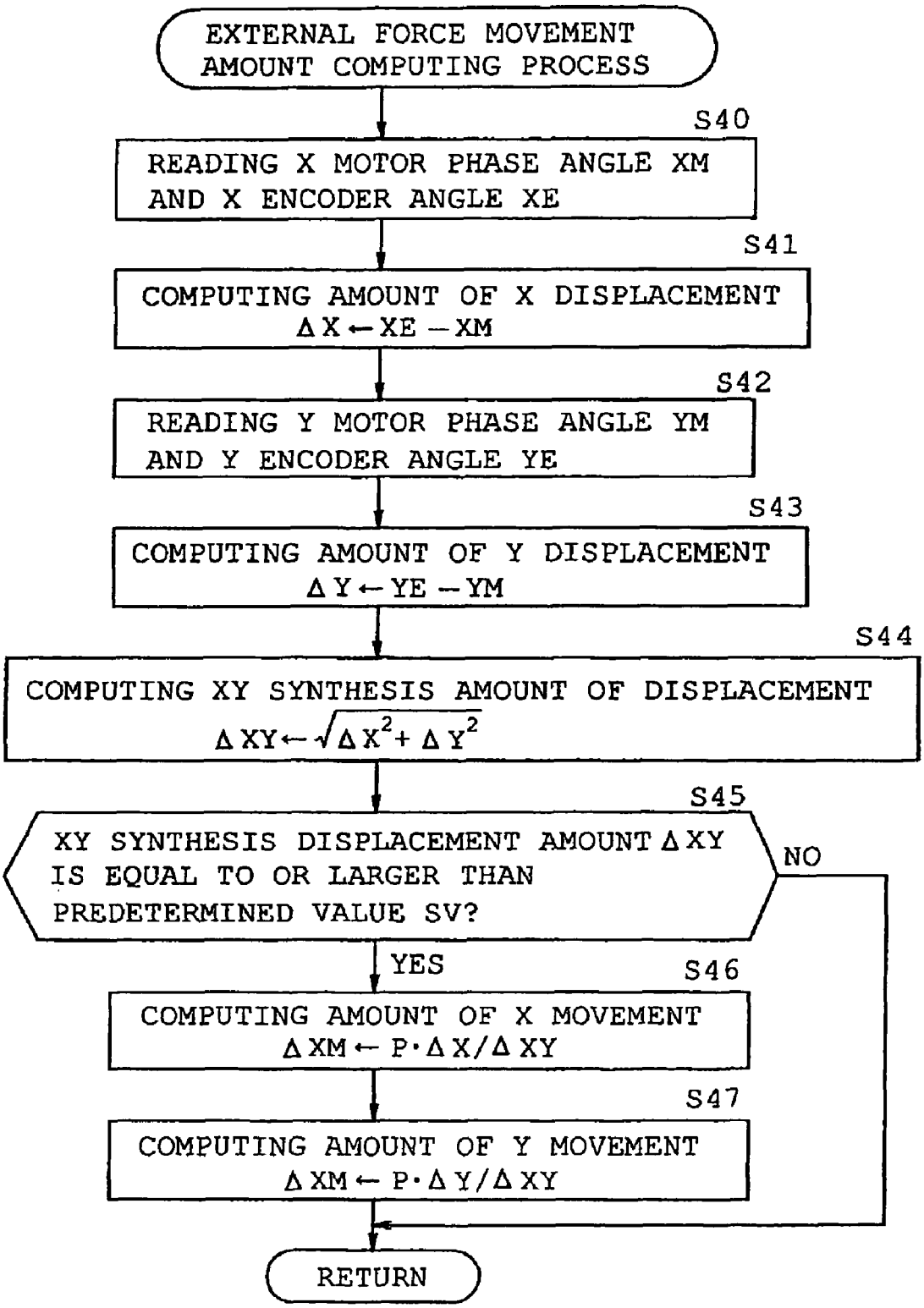
FIG. 8 is a flowchart showing a second half of control manner of the normal pattern sewing, namely, a process of obtaining an amount of movement of external force in a second illustrative example.
Figure 9:
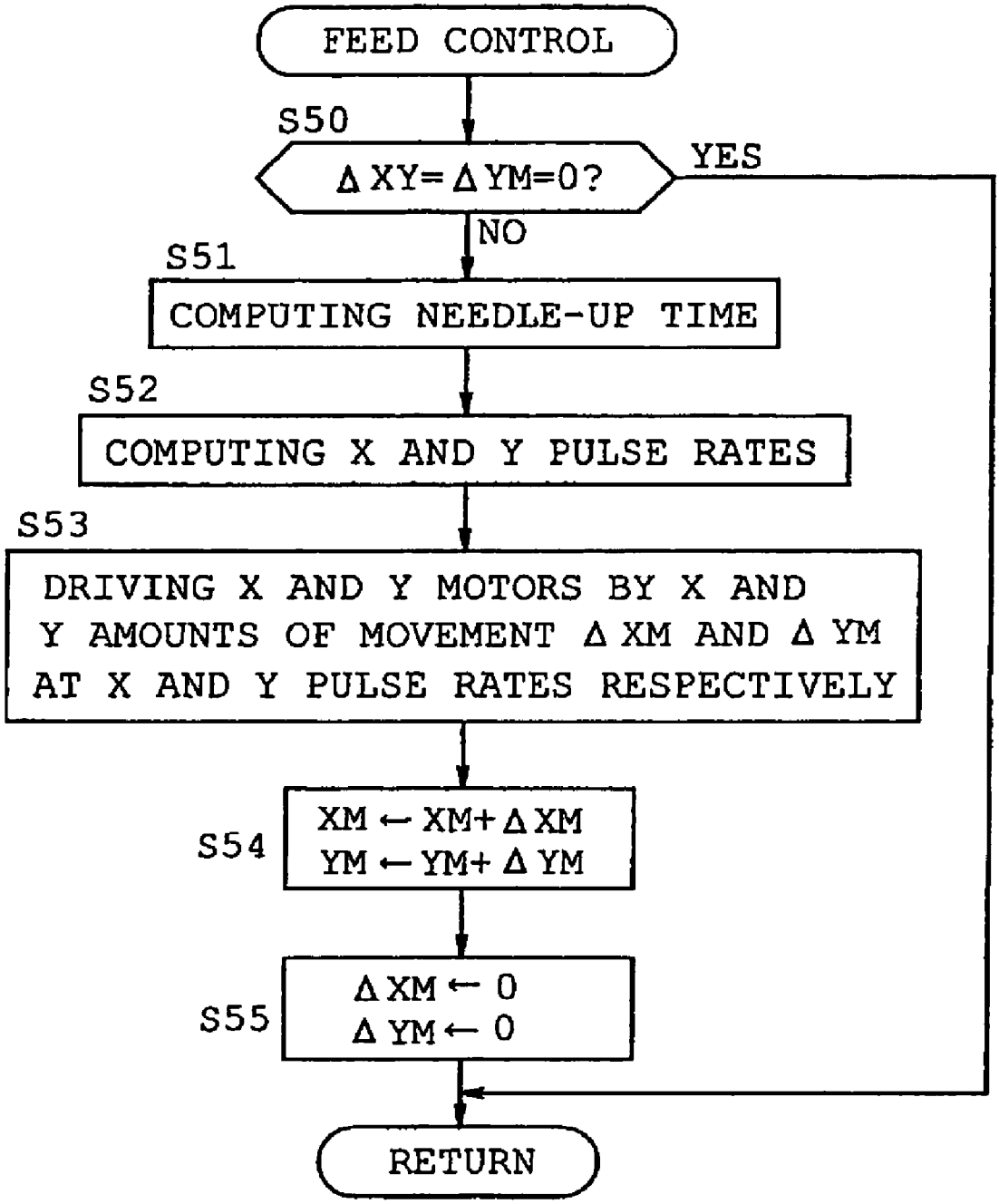
FIG. 9 is a flowchart showing a feed control.

FIGS. 7 to 9 illustrate a second illustrative example. The cloth-holder frame transfer apparatus of the second example differs from that of the first example in the ordinary pattern sewing control executed by the control device 9. The cloth-holder frame transfer apparatus of the second example is constructed and arranged in the same manner as that of the first example in the other respect.

In the ordinary pattern sewing control by the control device 9 executed by the control device 9 of the second example 2, when the operator applies an external force to the cloth-holder frame 6 attached to the carriage 19 in order to manually move the cloth-holder frame 6 in the same manner as in the first example, amounts of displacement of the X and Y motors 23 and 31 are detected by the X and Y rotary encoders 41 and 42 respectively. As a result, the external force the operator applies to the cloth-holder frame 6 is indirectly detected. The X and Y carriage driving mechanisms 20, 30 (X and Y motors 23 and 31) are controlled based on the external force detected by the rotary encoders 41 and 42 respectively, whereby an assisting force assisting the movement of the cloth-holder frame 6 by the external force can be produced. In this case, the control device 9 controls the X and Y carriage driving mechanisms 20 and 30 so that the assisting force is produced in the direction of the external force only when the cloth-holder frame 6 assumes the needle-up position where the sewing needle 10 is located higher than the workpiece cloth in the case where the magnitude of the external force detected when the sewing needle 10 is stuck into the workpiece cloth held on the cloth-holder frame 6 is equal to or larger than the predetermined threshold and so that an amount of movement of the cloth-holder frame 6 becomes constant irrespective of the magnitude of the external force.

Next, the ordinary pattern sewing control carried out by the control device 9 will be described with reference to the flowcharts of FIGS. 7 to 9. Symbol Si (where i=30, 31, 32 . . . ) designates each step in the figures. A control sequence including the ordinary pattern sewing control is similar to that shown in FIG. 5 in the first example and the description thereof will be eliminated. It is assumed that the operator would previously set a stitch pitch in the control device 9 using the operation panel 8 in the ordinary pattern sewing control at S6.

Upon start of the ordinary pattern sewing control, an amount of pressing of the foot controller 45 is detected as shown in FIG. 7. When the amount of pressing is equal to or larger than a predetermined value (S30: Yes), a main shaft rotating speed is set according to the detected amount of pressing (S31). The sewing machine motor 16 is controlled so that the main shaft rotating speed is reached. After the main shaft rotating speed has been set in S31 or when determination has been made in the negative (S30: No), it is determined whether the sewing needle 10 assumes the upper position where the sewing needle 10 is located higher than the workpiece cloth (S32). When the sewing needle 10 assumes the needle-down position (S32: No), the external force movement computing process (S33) is carried out. When the sewing needle 10 assumes the needle-up position (S32: Yes), the feed control (S34) is carried out. When the sewing completion is instructed (S35: Yes) after S34, the control device 9 returns. When the sewing completion is not instructed (S35: No), the control device 9 advances to S30 again.

Upon start of the external force movement amount computing process, as shown in FIG. 8, S40 to S45 which are similar to S20 to S25 in the first illustrative example are carried out. When XY synthesis amount of displacement ΔXY is smaller than the predetermined value SV (S45: No), the control device 9 returns. On the other hand, when ΔXY is equal to or larger than SV (S45: Yes), an amount of X movement "ΔXM←P·ΔX/ΔXY" is computed (S46) and an amount of Y movement "ΔYM←P·ΔY/ΔXY is computed (S47).

Thereafter, the control device 9 returns. Symbol P designates a motor angle corresponding to the stitch pitch previously set at S6.

Upon start of the feed control, as shown in FIG. 9, it is determined whether both ΔXM and ΔYM are 0 (S50). When ΔXM=ΔYM=0 (S50: Yes), the control device 9 returns. When ΔXM=ΔYM≠0 (S50: No), a time (needle-up time) when the sewing needle 10 remains at the upper position is computed based on the main shaft rotating speed set at S31 (S51). Next, X and Y pulse rates are computed based on the needle-up time computed at S51, and ΔXM and ΔYM computed at S46 and S47 respectively (S52). At S52, drive start times of the X and Y motors 23 and 31 and pulse frequencies (X and Y pulse rates) produced to these motors 23 and 31 are computed so that transfer of the cloth-holder frame 6 corresponding to the previously set stitch pitch is completed within the needle-up time computed at S51, that is, so that the drive of X motor 23 corresponding to ΔXM computed at S46 and the drive of Y motor 31 corresponding to ΔYM computed at S47 are completed within the needle-up time computed at S51. The aforesaid drive start time is synchronized with the sewing needle 10 assuming the upper position, and a transfer time (more specifically, a time occupying large part of the needle-up time) approximately proportional to the needle-up time within the needle-up time is computed. The X and Y pulse rates may be computed so that the transfer of the cloth-holder frame 6 is carried out in the transfer time.

Subsequently, the X motor 23 is driven by ΔXM computed at S46 according to the X pulse rate computed at S52, and the Y motor 31 is driven by ΔYM computed at S47 according to the Y pulse rate computed at S52 (S53). Next, the X motor transfer angle "XM←XM+ΔXM" and the Y motor transfer angle "YM←YM+ΔYM" are renewed and stored (S54). Lastly, an amount of X movement (ΔXM←0) and an amount of Y movement (ΔYM←0) are cleared to 0 (S55). The control device 9 then returns.

As obvious from the foregoing, the amount of X movement ΔXM and the amount of Y movement ΔYM are computed in the case where the amount of XY synthesis displacement ΔXY is equal to or larger than the predetermined value SV when the sewing needle 10 is assuming the lower position and the operator applies the external force to the cloth-holder frame 6. Thereafter, the X and Y motors 23 and 31 are driven by the obtained ΔXM and ΔYM respectively while the sewing needle 10 is at the upper position so that the cloth-holder frame 10 attached to the carriage 19 is transferred by a predetermined amount of transfer (stitch pitch) in the direction of the external force. As a result, straight stitches are formed on the workpiece cloth.

According to the cloth-holder frame transfer apparatus 7 of the second example, the control device 9 controls the X and Y carriage driving mechanisms 20 and 30 (the X and Y motors 23 and 31) based on the external force detected by the X and Y rotary encoders 41 and 42 while the sewing needle 10 is at the needle-down position. Thus, while a case can be assumed where it is difficult to detect the external force accurately by output of assisting force with the sewing needle 10 assuming the needle-up position, the external force is accurately detected when the sewing needle 10 is at the needle-down position. The detected external force can be reflected in the control of the X and Y carriage driving mechanisms 20 and 30 by the control device 9.

Furthermore, the control device 9 controls the X and Y carriage driving mechanisms 20 and 30 so that an amount of movement of the cloth-holder frame 6 becomes constant irrespective of the magnitude of the external force detected by the X and Y rotary encoders 41 and 42. Consequently, stitches with a predetermined pitch can reliably be formed on the workpiece cloth. The cloth-holder frame transfer apparatus of the second example is basically the same as that of the first example in the other respects of the operation and effect.

Figure 10:
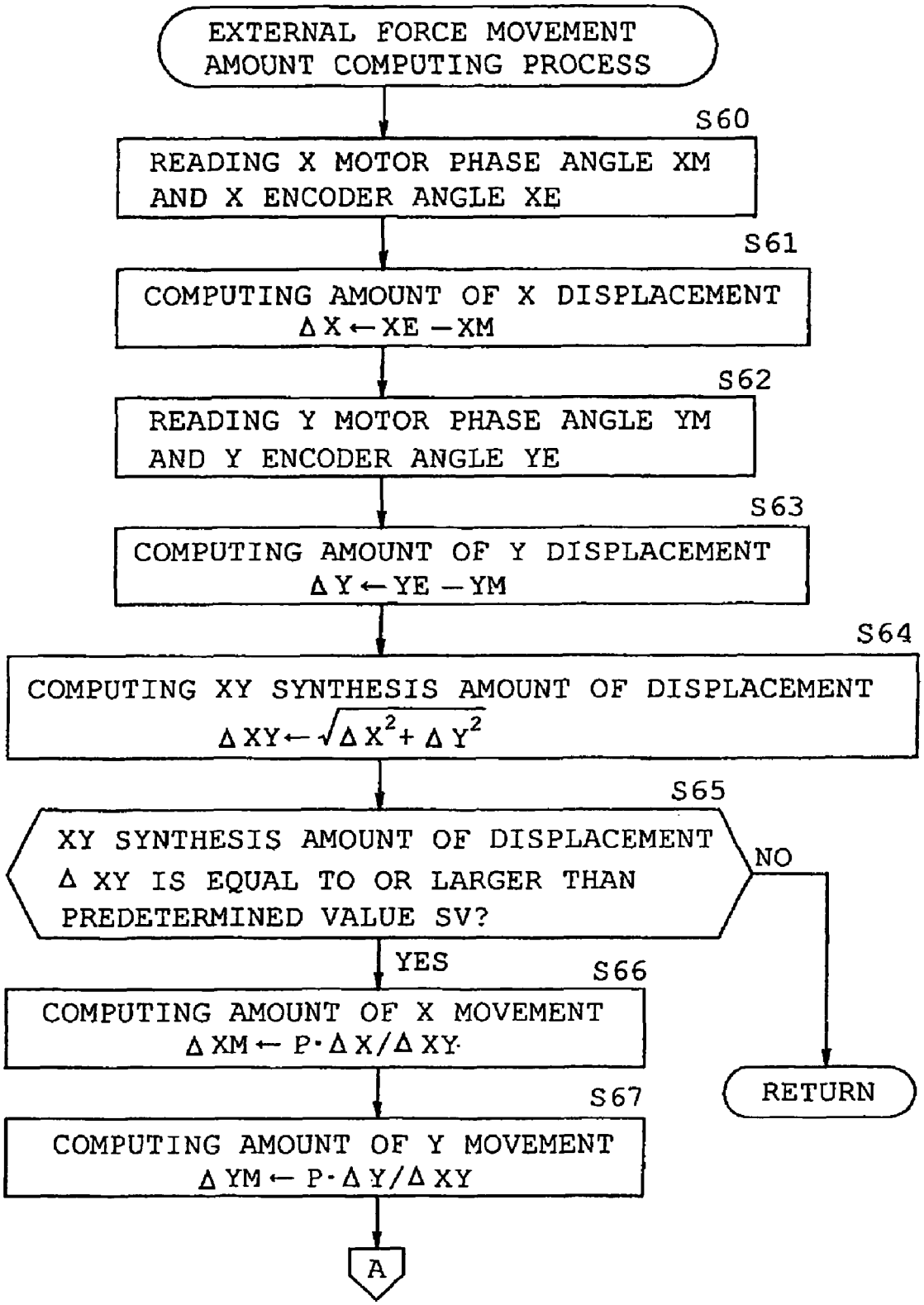
FIG. 10 is a flowchart showing a control manner of process of obtaining an amount of movement of external force in a third illustrative example.
Figure 11:
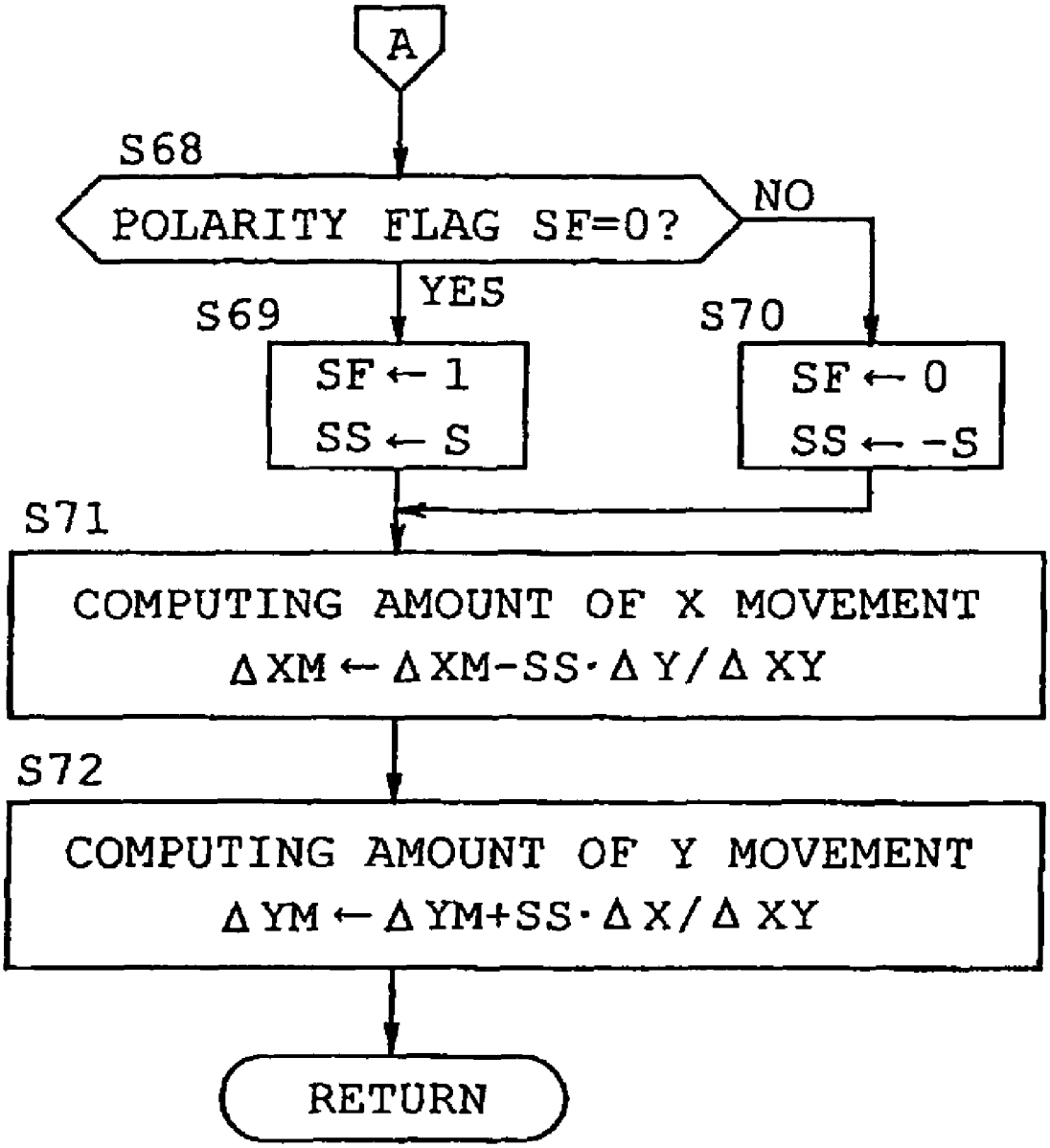
FIG. 11 is a flowchart showing a control manner of process of obtaining the amount of movement of external force.
Figure 12:
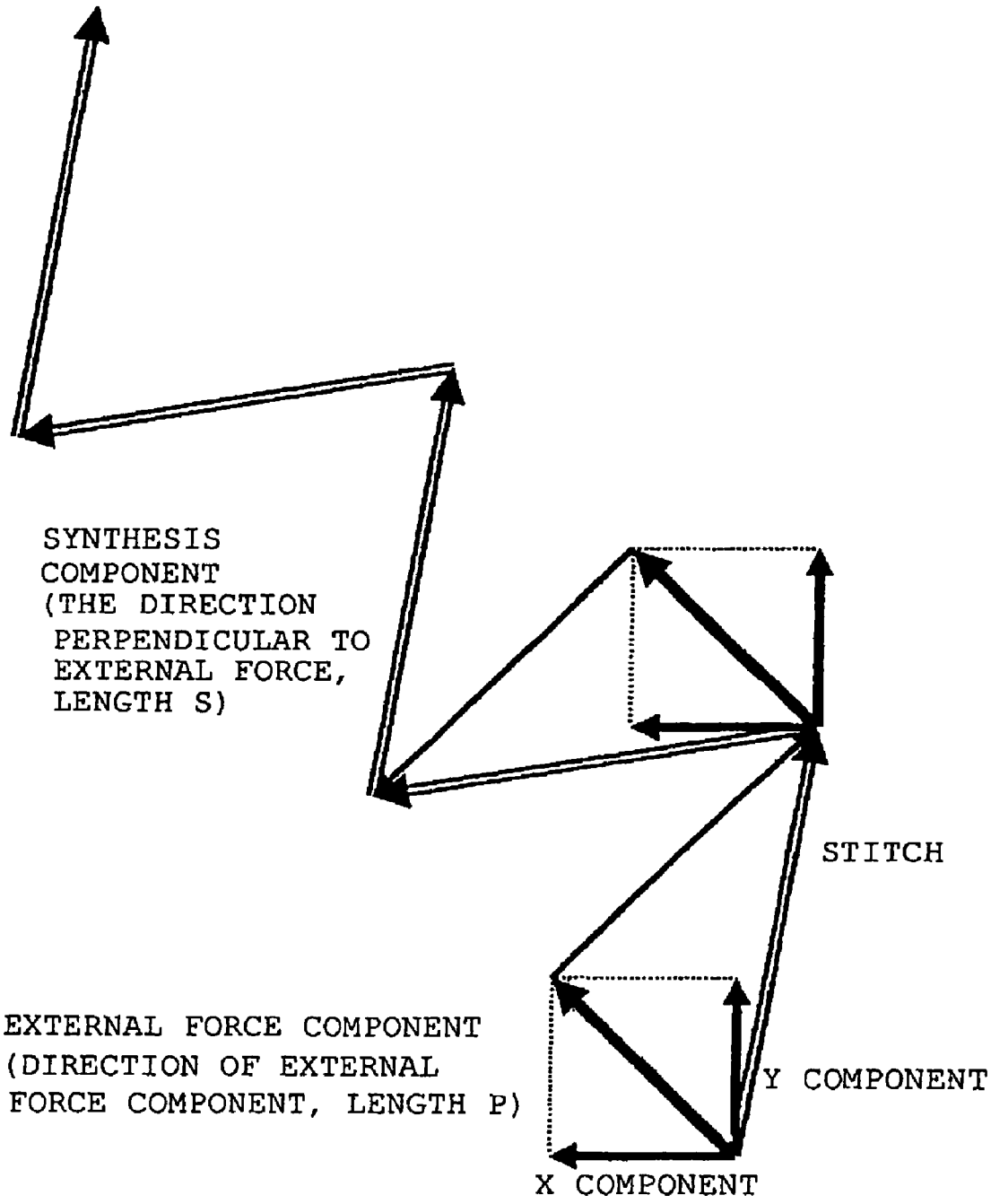
FIG. 12 shows a normal pattern to be formed on workpiece cloth.

FIGS. 10 to 12 illustrate third illustrative example. The cloth-holder frame transfer apparatus 7 of the third example differs from that of the second example in the external force movement amount computing process at S33 in FIG. 7 executed by the control device 9 in the second example. The cloth-holder frame transfer apparatus of the third example is constructed and arranged in the same manner as that of the second example in the other respect.

The external force movement amount computing process executed by the control device 9 in the third example will be described with reference to the flowchart of FIG. 10. Symbol Si (where i=60, 61, 62 . . . ) designates each step in the figures. In the ordinary sewing presetting process at S6 in FIG. 4, the operator previously sets a desired ordinary pattern, "satin pattern" and a stitchwise pitch and widthwise pitch (perpendicular to the stitchwise direction) of the satin pattern in the control device 9 using the operation panel 8.

Upon start of the external force movement amount computing process, S60 to S67 which are similar to S40 to S47 in FIG. 8 of the second example are carried out as shown in FIG. 10. However, the amounts of X and Y movement ΔXM and ΔYM computed at S66 and S67 are not final amounts of X and Y movement of the X and Y motors 23 and 31 respectively but amounts of X and Y movement process. Symbol P used in the computation designates a motor angle corresponding to the stitchwise pitch of the satin pattern. Subsequently, it is determined whether a polarity flag SF is 0 or 1 (S68) as shown in FIG. 11. The polarity flag SF is set to 0 (or 1) at the time of start of the external force movement amount computing process. When SF=0 (S68: Yes), SF←1 and SS←S (S69). When SF=1 (S68: No), SF←0 and SS←-S (S70). Symbol S designates a motor angle corresponding to the widthwise pitch of the satin pattern.

Subsequently, as shown in FIG. 12, a satin pitch is synthesized with the X movement amount ΔXM computed at S66, so that the X movement amount "ΔXM←ΔXM−SS·ΔY/ΔXY" is computed (S71). Furthermore, the satin pitch is also synthesized with the Y movement amount ΔYM computed at S67, so that the Y movement amount "ΔYM←ΔYM+SS·ΔX/ΔXY" (S72) and the control device 9 then returns. The X motor 23 is then driven by ΔXM computed at S71 with the sewing needle 10 assuming the needle-up position, and the Y motor 31 is driven by ΔYM computed at S72 with the sewing needle 10 assuming the needle-up position.

The X and Y movement process amounts ΔXM and ΔYM are computed when the operator applies an external force to the cloth-holder frame 6 with the sewing needle 10 assuming the needle-down position such that the XY synthesis displacement amount ΔXY is equal to or larger than the predetermined value SV. The satin pitch is synthesized with the computed each of the computed X and Y movement process amounts ΔXM and ΔYM, whereby X and Y movement amounts ΔXM and ΔYM are computed. Subsequently, the X and Y motors 23 and 31 are driven by obtained ΔXM and ΔYM while the sewing needle 10 is assuming the needle-up position. As a result, the cloth-holder frame 6 attached to the carriage 19 is transferred by a predetermined amount of transfer in the direction of the external force so that a satin pattern with a previously set constant width is formed on the workpiece cloth with the direction of the pattern serving as a main direction.

According to the cloth-holder frame transfer apparatus of the fourth example, the control device 9 controls the X and Y carriage driving mechanisms 20 and 30 so that the direction of the external force detected by the X and Y rotary encoders 41 and 42 is set as a main direction and the predetermined stitches are formed in the main direction, whereby the X and Y carriage driving mechanisms 20 and 30 deliver an assisting force. Accordingly, when the operator applies the external force so that the cloth-holder frame 6 is moved in such a direction that stitches are formed, the predetermined stitches can easily be formed in the main direction (the direction of external force). The cloth-holder frame transfer apparatus of the third example is basically the same as that of the second example in the other respects of the operation and effect.

FIGS. 13 to 16 illustrate a fourth example. The cloth-holder frame transfer apparatus 7 of the fourth example differs from that of the third example in S68 to S72 in FIG. 11 executed by the control device 9 in the third example. The cloth-holder frame transfer apparatus of the fourth example is constructed and arranged in the same manner as that of the third example in the other respect.

Figure 13:
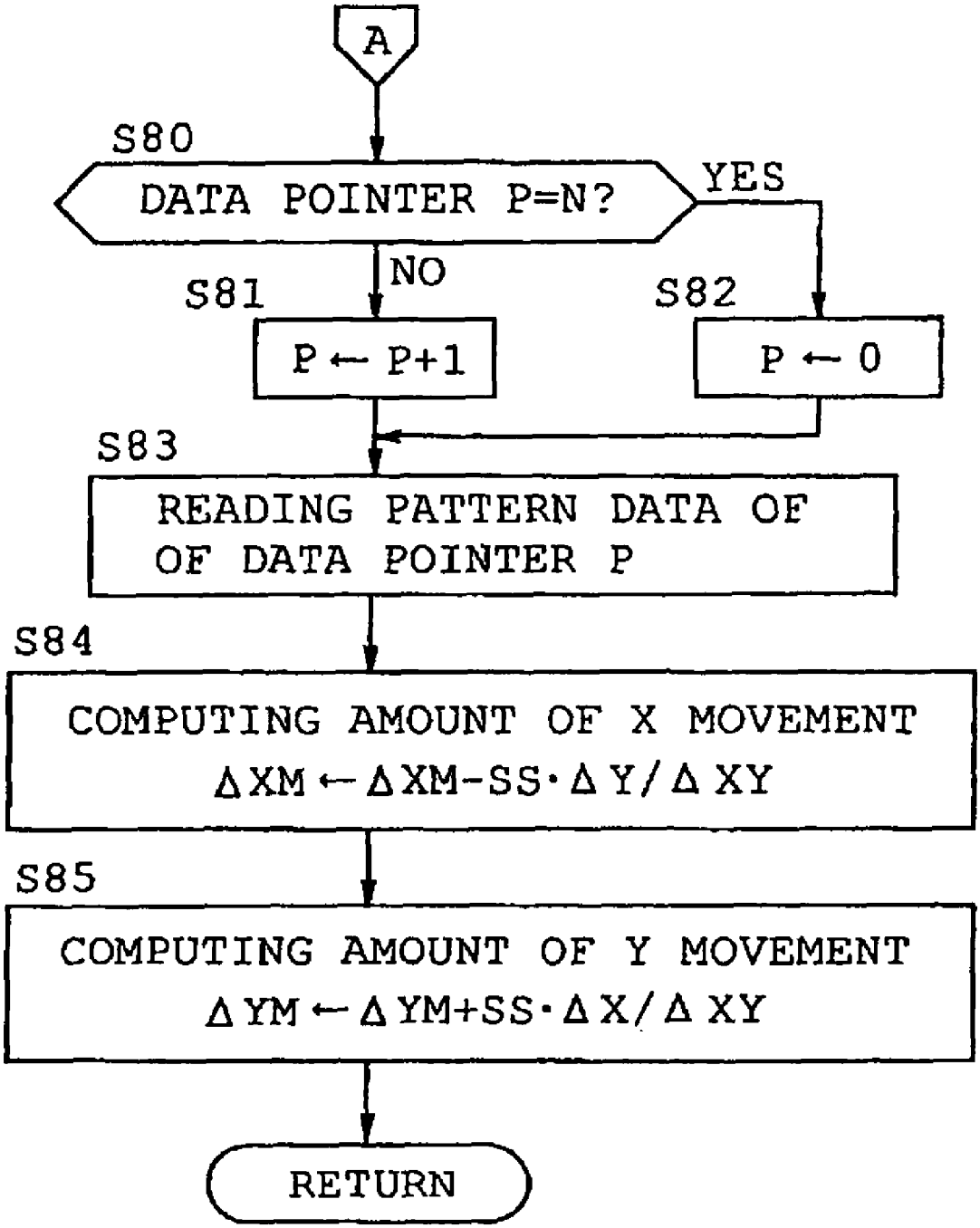
FIG. 13 is a flowchart showing a control manner of process of obtaining an amount of movement of external force in a fourth illustrative example.

The following will describe the external force movement amount computing process executed by the control device 9 of the fourth example. S80 to S85 in FIG. 13 are executed after S60 to S67 in FIG. 10. Symbol Si (where i=80, 81, 82 . . . ) designates each step in FIG. 13. When a satin pattern is set at S6, width data of data number N of satin pattern is prepared, for example, as shown in FIG. 14. In a shown example, N=74. It is determined whether data pointer P is N or not (S80) as shown in FIG. 13. When P≠N (S80: No), P is incremented (P←P+1). When P=N (S80: Yes), P is reset (P←0) (S82). Subsequently, when pattern data (width data) for the data pointer P is read (S83), the read data serves as SS. Pattern data is synthesized into the X movement process amount ΔXM at S66 so that the X movement amount "ΔXM←ΔXM−SS·ΔY/ΔXY" is computed (S84). Consecutively, the pattern data is synthesized into the Y movement process amount ΔYM obtained at S67 so that the Y movement amount "ΔYM←ΔYM+SS·ΔX/ΔXY" is computed (S85). The control device 9 then returns. At S53 in FIG. 9, the X motor 23 is driven by ΔXM obtained at S84 while the sewing needle 10 is at the needle-up position and the Y motor 31 is driven by ΔYM obtained at S85.

Figure 15:
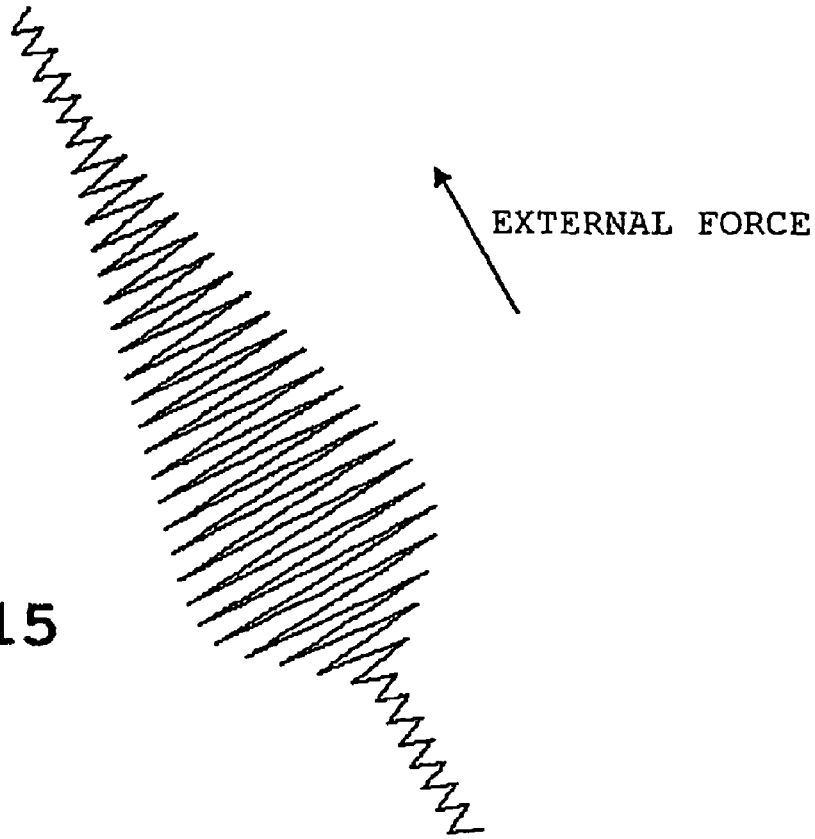
FIG. 15 shows a normal pattern to be formed on workpiece cloth.
Figure 16:
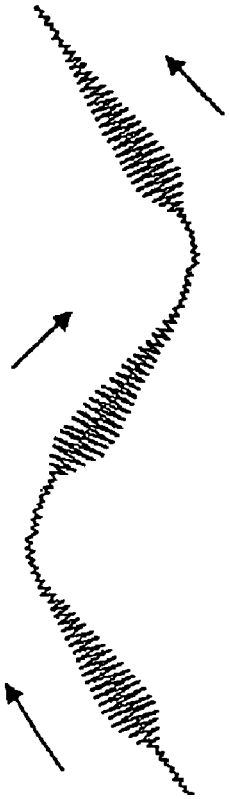
FIG. 16 shows a normal pattern to be formed on workpiece cloth.

The operator applies the external force to the cloth-holder frame 6 while the sewing needle 10 is at the needle-down position. As a result, when the Y synthesis displacement amount ΔXY is equal to or larger than the predetermined value SV, the X movement process amount ΔXM and Y movement process amount ΔYM are computed. The pattern data is synthesized into each of the ΔXM and ΔYM so that the X and Y movement amounts ΔXM and ΔYM are computed. Subsequently, the X and Y motors 23 and 31 are driven by the obtained ΔXM and ΔYM respectively while the sewing needle 10 is at the needle-up position, whereby the cloth-holder frame 6 attached to the carriage 19 is transferred by a predetermined amount in the direction of the external force as shown in FIG. 15. As a result, the ordinary pattern having a changing width is formed on the workpiece cloth with the direction of transfer of the carriage serving as a main direction. This sewing manner is consecutively carried out so that a group of ordinary patterns is formed continuously as shown in FIG. 16. The cloth-holder frame transfer apparatus 7 of the fourth example can achieve the same operation and effect as those of the third example.

FIGS. 17 to 20 show a fifth illustrative example. The cloth-holder frame transfer apparatus 7 of the fifth example differs from that of the first example in the ordinary pattern sewing control executed by the control device 9. The cloth-holder frame transfer apparatus 7 of the fifth example is constructed and arranged in the same manner as that of the first example in the other respect.

In the ordinary pattern sewing control executed in the control device 9 in the fifth example, when the operator applies an external force to the cloth-holder frame 6 attached to the carriage 19 in order to move the frame manually, amounts of displacement of the X and Y motors 23 and 31 are detected by the X and Y rotary encoders 41 and 42 respectively in the same manner as in the first example. As a result, the external force the operator has applied to the cloth-holder frame 6 attached to the carriage 19 is indirectly detected. The X and Y carriage driving mechanisms 20 and 30 (X and Y motors 23 and 31) are controlled based on the external force detected by the rotary encoders 41 and 42, so that a force assisting the movement of the cloth-holder frame 6 by the external force is produced.

In the above-described case, the control device 9 controls so that the assisting force is produced in the direction of the external force only when the sewing needle 10 is assuming the needle-up position in the case where the external force detected when the sewing needle 10 is assuming the needle-down position in the case where the magnitude of the external force is equal to or larger than the threshold. Furthermore, the control device 9 controls the X and Y carriage driving mechanisms 20 and 30 so that an amount of movement of the cloth-holder frame 6 becomes constant irrespective of the magnitude of the external force. The control device 9 further controls the sewing machine motor 16 so that the sewing machine motor 16 is operated according to the magnitude of the detected external force.

The ordinary pattern sewing control carried out by the control device 9 will be described with reference to the flowcharts of FIGS. 17 to 20. Symbol Si (where i=90, 91, 92 . . . ) designates each step in the figures. The control sequence including the ordinary pattern sewing control is similar to that shown in FIG. 5 in the first example and the description thereof will be eliminated. It is assumed that the operator would previously set a stitch pitch in the control device 9 using the operation panel 8 in the ordinary pattern sewing control at S6.

Figure 17:
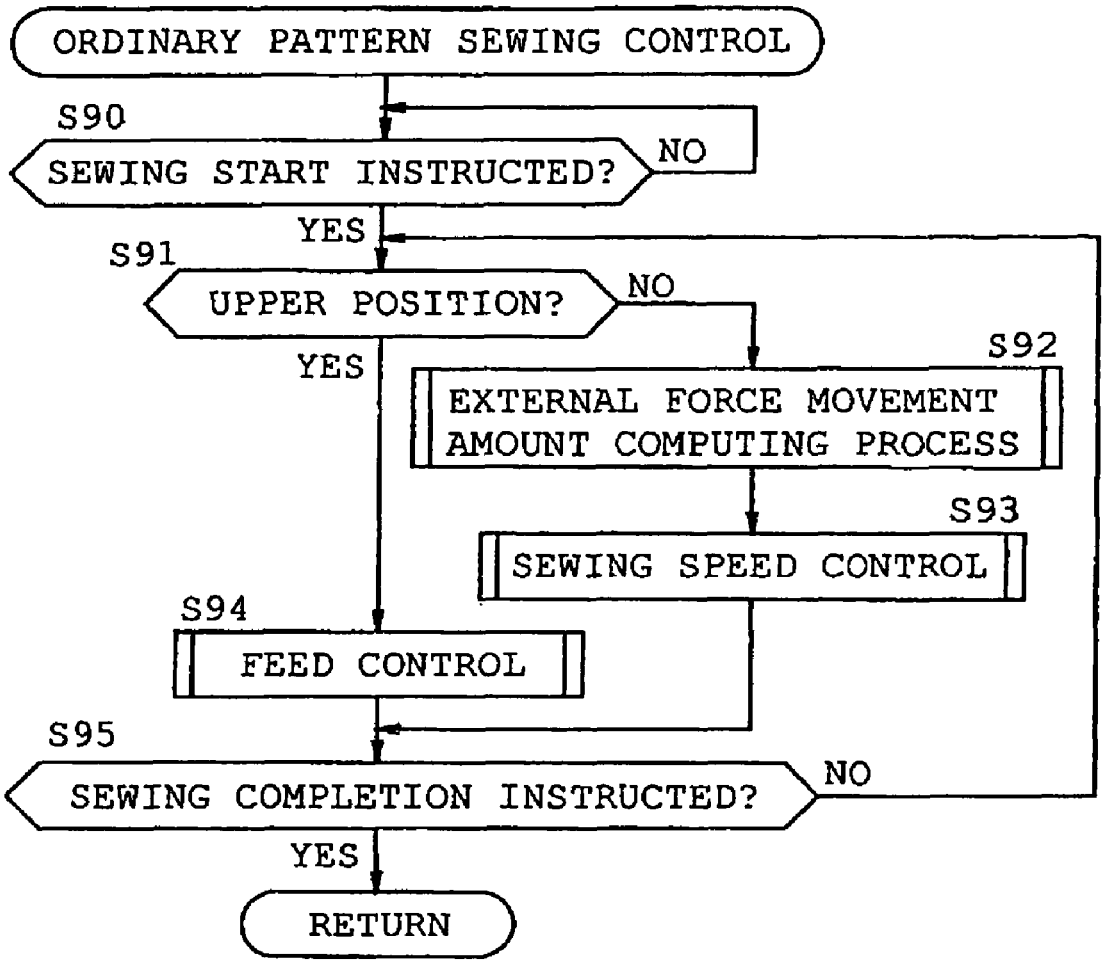
FIG. 17 is a flowchart showing a control manner of normal pattern sewing in a fifth illustrative example.

Upon start of the ordinary pattern sewing control, it is determined whether the sewing needle 10 is at the needle-up position (S91) when sewing start has been instructed (S90: Yes) as shown in FIG. 17. When the sewing needle 10 is at the needle-down position (S91: No), the external force movement amount computing process (S92) and the sewing speed control (S93) are carried out. On the other hand, when the sewing needle 10 is at the needle-up position (S91: Yes), the feed control (S94) is carried out. When sewing completion is instructed after execution of S93 and S94 (S95: Yes), the control device 9 returns. When sewing completion has not been instructed (S95: No), the control device 9 advances to S91 again.

Figure 18:
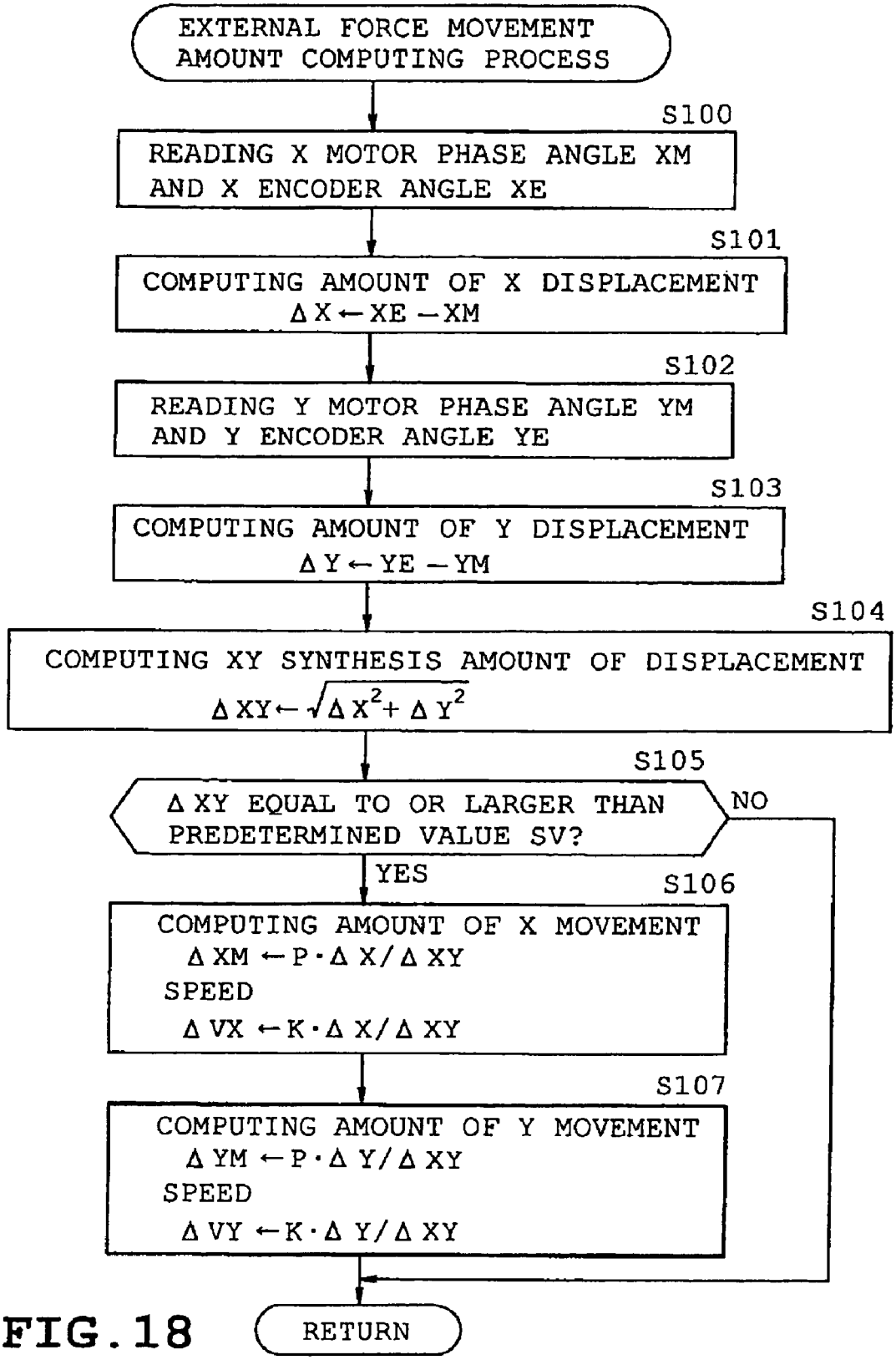
FIG. 18 is a flowchart of external force processing.

Upon start of the external force movement amount computing process, S100 to S105 which are similar to S20 to S25 in FIG. 6 of the first example respectively are carried out as shown in FIG. 18. When the XY synthesis displacement amount ΔXY is smaller than the predetermined value SV (S105: No), the control device 9 returns. When the XY synthesis displacement amount ΔXY is equal to or larger than the predetermined value SV (S105: Yes), an amount of X movement "ΔXM←P·ΔX/ΔXY" and an X movement speed "VX←K·ΔX/ΔXY" are computed (S106). An amount of Y movement "ΔYM←P·ΔY/ΔXY" and a Y movement speed "VY←K·ΔY/ΔXY" are computed (S107). The control device 9 then returns. Symbol P designates a motor angle corresponding to the stitch pitch previously set at S6 and symbol K designates a predetermined transfer speed.

Figure 19:
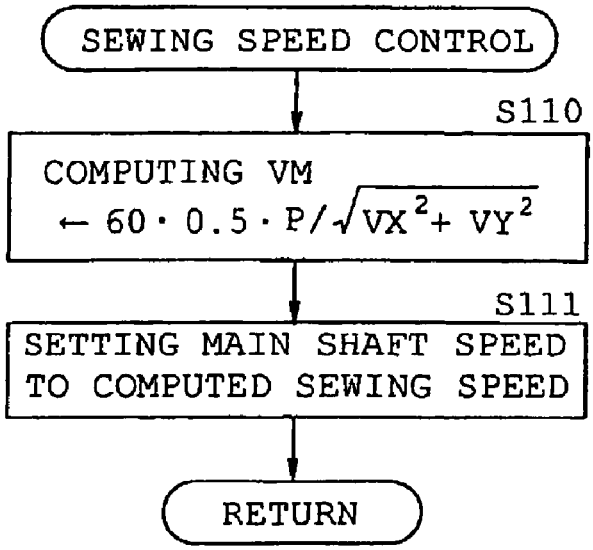
FIG. 19 is a flowchart of sewing speed control.

Upon start of the sewing speed control, as shown in FIG. 19, a sewing speed "$VM \leftarrow 60 \cdot 0.5 \cdot P/(VX^2+VY^2)^{1/2}$) is computed (S110). When VM is set to the main shaft rotating speed (sewing speed) (S111), the sewing machine motor 16 is controlled so that the main shaft rotating speed VM is reached, then returning.

Figure 20:
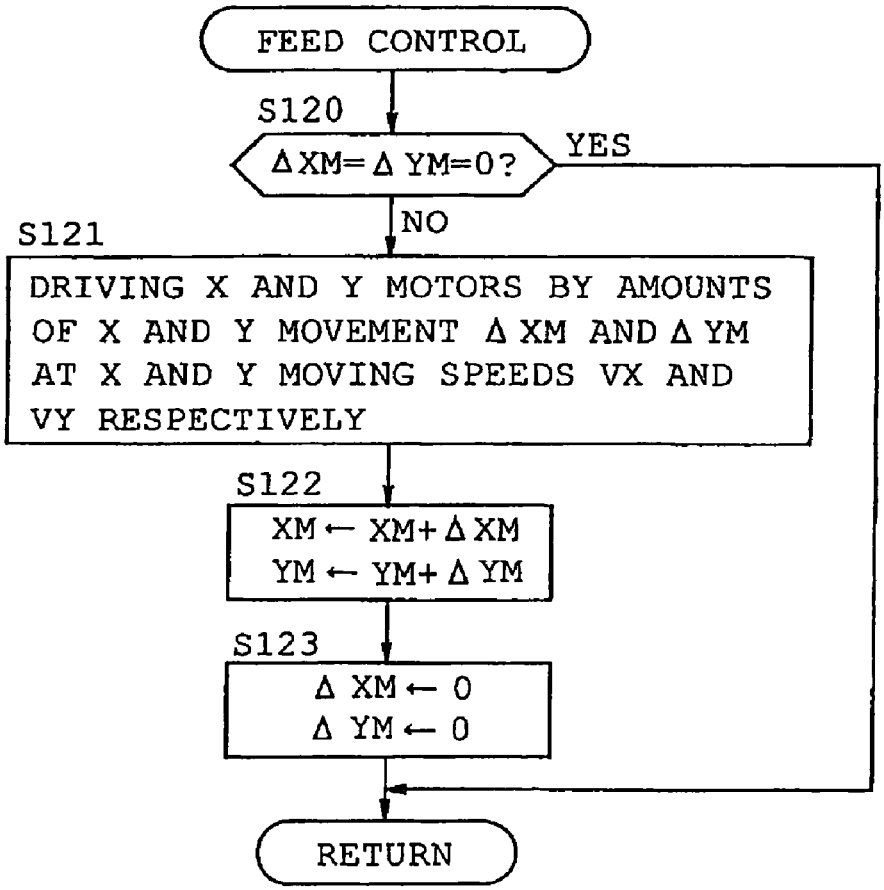
FIG. 20 is a flowchart of feed control.

Upon start of the feed control, as shown in FIG. 20, it is determined whether ΔXM and ΔYM computed at S106 and S107 respectively are 0 (S120). When ΔXM=ΔYM=0 (S120: Yes), the control device 9 returns. When ΔXM=ΔYM≠0 (S120: No), the X motor 23 is at the speed VX computed at S106 by ΔXE, and the Y motor 31 is driven at the speed VY computed at S107 by ΔYM (S121). Next, the X motor transfer angle "XM←XM+ΔXM" and the Y motor transfer angle "YM←YM+ΔYM" are renewed and stored (S122). Lastly, the control device 9 clears an X movement amount ΔXM←0 and Y movement amount "ΔYM←0" into 0 (S123), then returning.

According to the cloth-holder frame transfer apparatus 7, the control device 9 controls the sewing machine motor 16 moving up and down the needlebar 11 to which the sewing needle 10 is attached according the magnitude of the external force detected by the X and Y rotary encoders 41 and 42. Accordingly, no operation of the foot-controller 45 and the like is necessary in the sewing. The operator changes the magnitude of the external force to be applied to the cloth-holder frame 6 such that the moving speed of the needlebar 11 or the sewing speed can be changed. Consequently, the convenience of the cloth-holder frame transfer apparatus can be improved. The cloth-holder frame transfer apparatus of the fifth example is basically the same as that of the first and second examples in the other respects of the operation and effect.

The first to fifth examples may be modified as follows. The X and Y rotary encoders 41 and 42 are provided for indirectly detecting the external force the operator applies to the cloth-holder frame 6 attached to the carriage in the foregoing examples. However, any detector may be provided which detects amounts of displacement of components (the carriage 19, a belt or the like) other than the X and Y motors 23 and 31 of the carriage driving mechanisms 20 and 30. In this case, the detector may detect the displacement amounts mechanically or optically.

The external force detector may directly detect the external force the operator applies to the cloth-holder frame 6 attached to the carriage, instead. For example, one or a plurality of pressure sensors detecting pressure applied to the cloth-holder frame 6 may be provided on a connection between the carriage 19 (the frame holder 18) and the cloth-holder frame 6. Furthermore, the assisting force output device assisting the movement of the cloth-holder frame 6 by the external force may comprise a mechanism having an actuator (an air cylinder or the like) which is separate from the X and Y carriage driving mechanisms 20 and 30. Furthermore, various mechanisms such as carriage driving mechanisms may be provided for moving the carriage in an R-θ direction, instead of the X and Y carriage driving mechanisms 20 and 30.

Furthermore, DC servomotors may be employed as the X and Y motors 23 and 31, instead of the stepping motors. Additionally, actuators such as air cylinders may he employed. Furthermore, the needlebar 11 may be constructed to be swingable so that zigzag stitches are realized in synchronization with movement of the cloth-holder frame 6. In this case, the cloth-holder frame 6 can be moved even when the sewing needle 10 is at the needle-down position where the sewing needle 10 is stuck into the workpiece cloth. Accordingly, the cloth-holder frame transfer apparatus may be constructed so that the assisting force is produced when the sewing needle is at the needle-down position.

Furthermore, pattern data is synthesized in the direction perpendicular to the direction of the external force in the foregoing examples. However, a pattern with any directional component including a direction of external force may be synthesized. Additionally, the disclosure may be applied to various types of embroidery sewing machines (industrial multineedle sewing machines, household single-needle sewing machines), instead of the above-described multineedle sewing machine M.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. A cloth-holder frame transfer apparatus for a sewing machine which is usable with a cloth-holder frame, the apparatus comprising:

a carriage detachably attachable to the cloth-holder frame holding workpiece cloth;

a carriage driving mechanism including an actuator moving the carriage in two directions intersecting each other on a horizontal plane;

an external force detector which detects an external force applied by an operator to the cloth-holder frame attached to the carriage;

an assisting force output device which produces force assisting the movement of the cloth-holder frame by the external force; and a control device which controls the assisting force output device based on the external force detected by the external force detector, wherein:

the carriage driving mechanism includes first and second direction movement actuators which are provided with first and second direction displacement sensors respectively; and the first and second direction movement actuators comprise respective stepping motors, and the first and second direction displacement sensors comprise respective rotary encoders.

2. The apparatus according to claim 1, wherein the control device actuates the assisting force output device when the external force detected by the external force detector has a magnitude equal to or larger than a predetermined threshold.

3. The apparatus according to claim 2, wherein the control device controls the assisting force output device so that the assisting force is produced in a direction of the external force detected by the external force detector.

4. The apparatus according to claim 1, wherein the assisting force output device shares the first and second direction movement actuators with the carriage driving mechanism.

5. The apparatus according to claim 1, wherein the assisting force output device comprise the carriage driving mechanism, and the control device controls the carriage driving mechanism so that the cloth-holder frame is moved in the direction the external force detected by the external force detector.

6. The apparatus according to claim 5, wherein the control device controls the carriage driving mechanism so that an amount of movement of the cloth-holder frame is varied according to a magnitude of the external force detected by the external force detector.

7. The apparatus according to claim 5, wherein the control device controls the carriage driving mechanism so that an amount of movement of the cloth-holder frame is constant irrespective of a magnitude of the external force detected by the external force detector.

8. The apparatus according to claim 7, wherein the sewing machine includes a sewing needle, a needlebar to which the sewing needle is attachable and a sewing machine motor driven to move up and down the needlebar attached with the sewing needle, and the control device controls the sewing machine motor according to a magnitude of the external force detected by the external force detector.

9. The apparatus according to claim 7, wherein the control device controls the assisting force output device so that an assisting force for forming a predetermined stitch is produced in a direction of the external force detected by the external force detector.

10. The apparatus according to claim 1, wherein the sewing machine includes a needlebar to which a sewing needle is attachable, the apparatus further comprising a needlebar position detector which detects a vertical position of the needlebar to which the sewing needle is attached, wherein the control device controls the assisting force output device so that the assisting force output device is actuated only when the sewing needle assumes a needle-up position where the sewing needle is located higher than the workpiece cloth.

11. The apparatus according to claim 10, wherein the control device controls the assisting force output device based on the external force detected by the external force detector when the sewing needle assumes a needle-down position where the sewing needle is stuck into the workpiece cloth.

12. The apparatus according to claim 1, wherein the sewing machine includes a sewing needle, a needlebar to which the sewing needle is attachable and a sewing machine motor driven to move up and down the needlebar attached with the sewing needle, and the control device controls the sewing machine motor according to a magnitude of the external force detected by the external force detector.

13. The apparatus according to claim 1, wherein the control device controls the assisting force output device so that an assisting force for forming a predetermined stitch is produced in a direction of the external force detected by the external force detector.

* * * * *